US006431896B2

(12) United States Patent
Saito et al.

(10) Patent No.: US 6,431,896 B2
(45) Date of Patent: Aug. 13, 2002

(54) CONNECTOR

(75) Inventors: Masashi Saito, Yokkaichi; Kensaku Takata, Nagoya; Masanori Wakui; Kazuyuki Shiraki, both of Toyota, all of (JP)

(73) Assignees: Autonetworks Technologies, Ltd., Aichi; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/855,623

(22) Filed: May 16, 2001

(30) Foreign Application Priority Data

Jun. 26, 2000 (JP) ..... 2000-191520

(51) Int. Cl.[7] ..... H01R 13/15
(52) U.S. Cl. ..... 439/259; 439/342
(58) Field of Search ..... 439/259, 342, 439/343, 157, 347, 350, 261, 330, 331, 265

(56) References Cited

U.S. PATENT DOCUMENTS 5,478,255 A * 12/1995 Hashiguchi ..... 439/342
5,975,929 A 11/1999 Matsuura et al. ..... 439/157

FOREIGN PATENT DOCUMENTS

EP 0 967 692 A2 12/1999

* cited by examiner

*Primary Examiner*—P. Austin Bradley
*Assistant Examiner*—Ross Gushi
(74) *Attorney, Agent, or Firm*—Oliff & Berridge PLC

(57) ABSTRACT

When the holder 20 is assembled to the male side housing 10 (stationary side housing), the cam grooves 23*a*, 23*b* respectively engage with the cam pins 41*a*, 41*b*, so that the female side housing 40 (movable side housing) is displaced in a direction perpendicular to the assembling direction and located at the connecting position, so that both the terminal metal fittings 18, 50 are connected with each other. At this time, due to the friction caused between the terminal metal fittings 18, 50, a force resisting displacement of the female side housing 40 and also resisting assembly of the holder 20 is generated. However, a cam action is exerted by the cam grooves 23*a*, 23*b* which are oblique with respect to the assembling direction. Therefore, an intensity of the operation force to be given to the holder 20 in the assembling direction is low. When the above structure is adopted, it is unnecessary to provide a manual operation member which is independent as an assembly force reducing means.

18 Claims, 20 Drawing Sheets

CONNECTOR

BACKGROUND OF THE INVENTION

1. Technical Field

The present invention relates to a connector in which the operation force for assembling is reduced.

2. Related Art

Concerning the connector in which the operation force for assembling is reduced, there is provided a connector in which a manual operation lever is arranged so that its lever action (cam action) can be utilized. Further, there is provided a connector in which the operation force can be reduced without providing a manual operation member. An example of this connector is disclosed in the U.S. Pat. No. 5,975,929. This connector is composed in such a manner that a female side housing is retractably accommodated in a holder, a base end of a lever is pivotally supported by the holder, and a cam groove at the middle position of the lever is engaged with a cam pin in the female side housing. When the holder is engaged with a male side housing, the lever is rotated when a forward end of the lever comes into contact with the male side housing. In this case, a contact point of the lever with the male side housing becomes a point of force, so that a lever action can be exerted. Therefore, even if an assembly operation force of the holder to the male side housing is low, the female side housing can be positively engaged with the male side housing.

Problems to be Solved

In the above conventional connector, the lever is used which is an independent part used as a means for reducing an operation force. As a result, the number of parts is increased.

SUMMARY OF THE INVENTION

The present invention has been accomplished in view of the above circumstances. It is an object of the present invention to reduce the number of parts.

Means for Solving the Problems

The invention described in aspect 1 provides a connector comprising: a stationary side housing having a stationary side terminal metal fitting; a movable side housing having a movable side metal fitting capable of connecting with the stationary side terminal metal fitting; a holder capable of being assembled to the stationary side housing; and a guide means for displacing the movable side housing with respect to the holder in a direction oblique to the assembling direction between an initial position on the forward side of the assembling direction of the holder and a connecting position on the rear side in the assembling direction, wherein the movable side terminal metal fitting is disconnected from the stationary side terminal metal fitting in a direction perpendicular to the assembling direction at the initial position so that the connector can not be connected, and the movable side terminal metal fitting can be connected with the stationary side terminal metal fitting at the connecting position.

The invention described in aspect 2 provides a connector according to aspect 1 further comprising a holding means, which is arranged in the holder and the movable side housing, for holding the movable side housing at the initial position, the holding means being capable of being released from the holding condition when the holder comes into contact with the stationary side housing in the process of assembling the holder to the stationary side housing.

The invention described in aspect 3 provides a connector according to aspect 2, the holding means comprising: an elastic deflection piece arranged in one of the holder and the movable side housing, the elastic deflection piece exhibiting a holding function when it is engaged with the other of the holder and the movable side housing; and a releasing section, which is arranged in the stationary side housing, for elastically displacing the elastic deflection piece in the releasing direction when the releasing section comes into contact with the elastic deflection piece in the case where the movable side housing comes into contact with the stationary side housing and the more movement of the movable side housing in the assembling direction is restricted.

The invention described in aspect 4 provides a connector according to one of aspects 1 to 3, wherein the stationary side housing is fixed to a stationary member, the holder is fixed to an attaching member attached to the stationary member in the same direction as the assembling direction to the stationary side housing, the guide means is composed of a cam groove formed in the holder and a cam pin formed in the movable side housing and engaged with the cam groove, the holder includes an idly engaging groove continued to an end portion of the cam groove at which the cam pin is located when the movable side housing reaches the connecting position, and the cam pin is engaged with the idly engaging groove under the condition that the holder is assembled to the stationary side housing.

The invention described in aspect 5 provides a connector according to one of aspects 1 to 4, wherein the guide means is composed of a cam groove formed in the holder and a cam pin formed in the movable side housing and engaged with the cam groove, a plurality of cam grooves are provided in parallel to each other, and a plurality of cam pins are provided so that the plurality of cam pins can be engaged with the plurality of cam grooves.

The invention described in aspect 6 provides a connector according to aspect 5, wherein the plurality of cam grooves are obliquely arranged being shifted with respect to the assembling direction of the holder to the stationary side housing.

The present invention described in aspect 7 provides a connector according to one of aspects 1 to 6, further comprising an initial position returning means for preventing the movable side housing from separating from the stationary side housing when the movable side housing is located at a position on the connecting position side with respect to the initial position in the process in which the holder is disengaged from the stationary side housing, and for allowing the movable side housing to separate from the stationary side housing so that the movable side housing can be displaced while it follows the holder when the movable side housing reaches the initial position.

The present invention described in aspect 8 provides a connector according to aspect 7, the initial position returning means including a semi-lock means for preventing the movable side housing, which has returned to the initial position, from moving in the separating direction with respect to the stationary side housing, the preventing action being released when a predetermined separating force is given to the semi-lock means, wherein the holder and the movable side housing include an engaging means for engaging the movable side housing and the holder so that the movable side housing and the holder can be integrally displaced in the separating direction when the movable side housing returns to the initial position.

[Aspect 1]

When the holder is assembled to the stationary side housing under the condition that the movable side housing is set at the initial position, the movable side housing comes into contact with the stationary side housing in the process of assembly, so that the movable side housing can not be moved any more in the assembling direction. In this process, both the terminal metal fittings are kept in a non-engaging state. Therefore, no assembly resistance is caused by the friction between the terminal metal fittings. After that, when the assembling work proceeds, the movable side housing is displaced in a direction perpendicular to the assembling direction by the guide means, that is, the movable side housing is displaced to the connecting position, so that both the terminal metal fittings can be connected with each other. At this time, due to the friction caused between the terminal metal fittings, a resistant force is generated against the displacement of the movable side housing and the assembly of the holder. However, a cam action is exerted by the guide means which is arranged oblique to the assembling direction. Therefore, an intensity of the operation force in the assembling direction to be given to the holder may be low. According to the present invention, it is unnecessary to provide an independent manual operation member to be used as a means for reducing an intensity of the assembly force.

[Aspect 2]

When the holder is assembled to the stationary side housing, the movable side housing is held at the initial position by the holding means. Therefore, the cam action conducted by the guide means can be made effective, and an intensity of the assembly operation force can be positively reduced.

[Aspect 3]

The holding state in which the movable side housing is held by the elastic deflection piece can be positively released by the release section. Therefore, an engagement area of the elastic deflection piece can be extended, and the reliability of the holding function can be enhanced.

[Aspect 4]

Under the condition that the connection of the movable side terminal metal fitting with the stationary side terminal metal fitting is completed, even when a positional relation between the holder and the stationary side housing in the assembling direction fluctuates due to an error of assembly between the stationary member and the assembly member, the cam pin is kept in the idly engaging section. Therefore, a displacement in the direction perpendicular to the assembling direction of the movable side housing can be prevented, that is, a displacement from the connecting position to the initial position side can be prevented.

[Aspect 5]

A plurality of cam grooves are provided in parallel with each other. Accordingly, there is no possibility that the movable side housing is tilted with respect to the stationary side housing.

[Aspect 6]

The cam grooves are obliquely arranged in the assembling direction being shifted. Therefore, as compared with an arrangement in which the cam grooves are shifted in a direction parallel with the assembling direction or a direction perpendicular to the assembling direction, the posture of the housing can be effectively prevented from being tilted.

[Aspect 7]

In the process of disengaging the holder from the stationary side housing, in the beginning, the movable side housing, which is prevented from being disengaged from the stationary side housing by the initial position returning means, is displaced in a direction perpendicular to the disengaging direction from the connecting position to the initial position by the cam action of the guide means. After the movable side housing has been returned to the initial position, the movable side housing is displaced in the disengaging direction following the holder.

[Aspect 8]

Since the semi-lock means is provided, the movable side housing can be positively returned to the normal initial position. When a disengaging force is given from the holder to the movable side housing via the engaging means, the restriction to restrict an idle movement by the semi-lock means is released, and the movable side housing can be displaced in the disengaging direction following the holder. Therefore, no problems are caused in the disengaging motion of the holder.

BRIEF DESCRIPTION OF THE DRAWINGS

FIGS. 15A to 15D are partially enlarged cross-sectional views showing a means for holding a female side housing at an initial position, wherein FIG. 15A is a view showing a holding state before a holder is assembled, FIG. 15B is a view showing a state in which holding is released in the middle of assembly of a holder, FIG. 15C is a view showing a state in which assembly of a holder proceeds while holding is released, and FIG. 15D is a view showing a state in which assembly of a holder is completed.

FIGS. 16A to 16D are partially enlarged cross-sectional views showing a state in which holding of a female side housing held at an initial position is released, wherein FIG. 16A is a view showing a state before holding is released, FIG. 16B is a view showing a state in which holding is released, FIG. 16C is a view showing a state in which assembly of a holder proceeds while holding is released, and FIG. 16D is a view showing a state in which assembly of a holder is completed.

FIGS. 17A and 17B are views showing a positional relation between a female terminal metal fitting and a tab of a male terminal metal fitting when a female housing is located at an initial position, wherein FIG. 17A is a side view, and FIG. 17B is a laterally cross-sectional view.

FIGS. 18A and 18B are views showing a positional relation between a female terminal metal fitting and a tab of a male terminal metal fitting when a female housing is located at a connecting position, wherein FIG. 18A is a side view, and FIG. 18B is a laterally cross-sectional view.

FIGS. 20A and 20B are laterally cross-sectional views showing a positional relation between a female terminal metal fitting and a tab of a male terminal metal fitting of Embodiment 2, wherein FIG. 20A is a view showing a state in which a female side housing is located at an initial position, and FIG. 20B is a view showing a state in which a female side housing is located at a connecting position.

FIGS. 21A and 21B are laterally cross-sectional views showing a positional relation between a female terminal metal fitting and a tab of a male terminal metal fitting of Embodiment 3, wherein FIG. 21A is a view showing a state in which a female side housing is located at an initial position, and FIG. 21B is a view showing a state in which a female side housing is located at a connecting position.

FIGS. 22A and 22B are laterally cross-sectional views showing a positional relation between a female terminal metal fitting and a tab of a male terminal metal fitting of Embodiment 4, wherein FIG. 22A is a view showing a state in which a female side housing is located at an initial position, and FIG. 22B is a view showing a state in which a female side housing is located at a connecting position.

DETAILED DESCRIPTION OF THE PREFERRED EMBODIMENTS

EMBODIMENT 1

Figure 1:
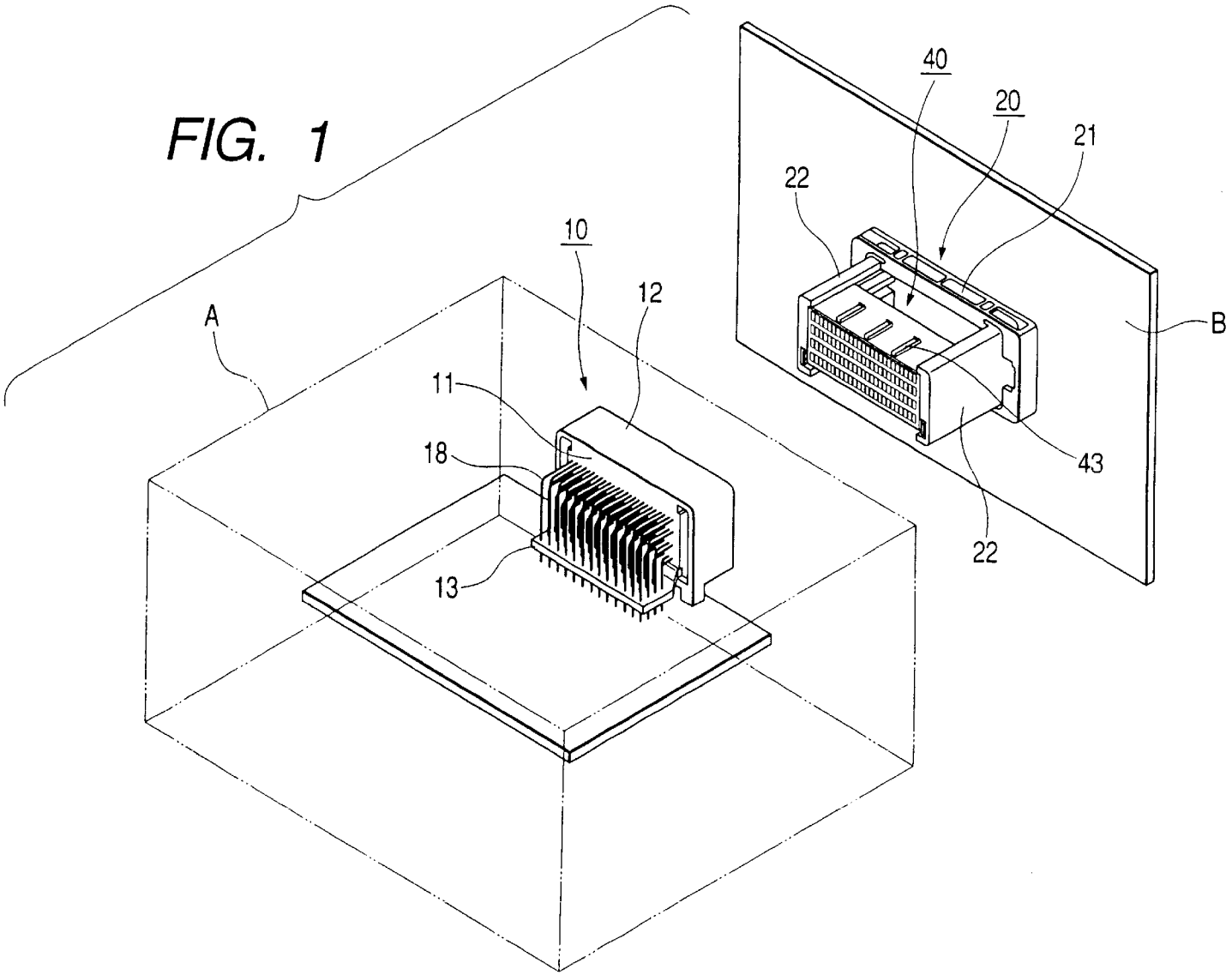
FIG. 1 is a perspective view showing a state before assembly of Embodiment 1.
Figure 2:
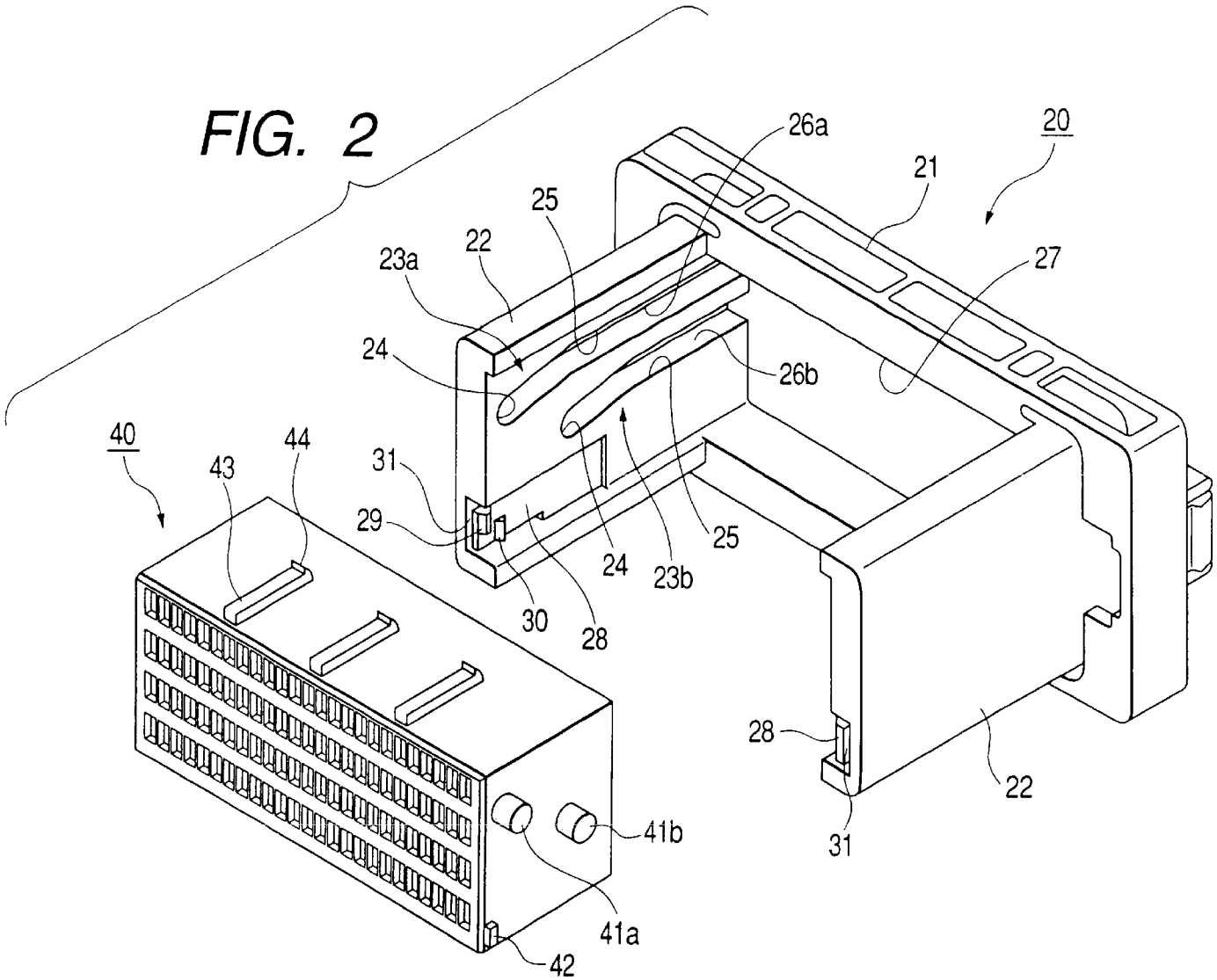
FIG. 2 is a perspective view showing a state of separation of a holder from a female side housing.
Figure 3:
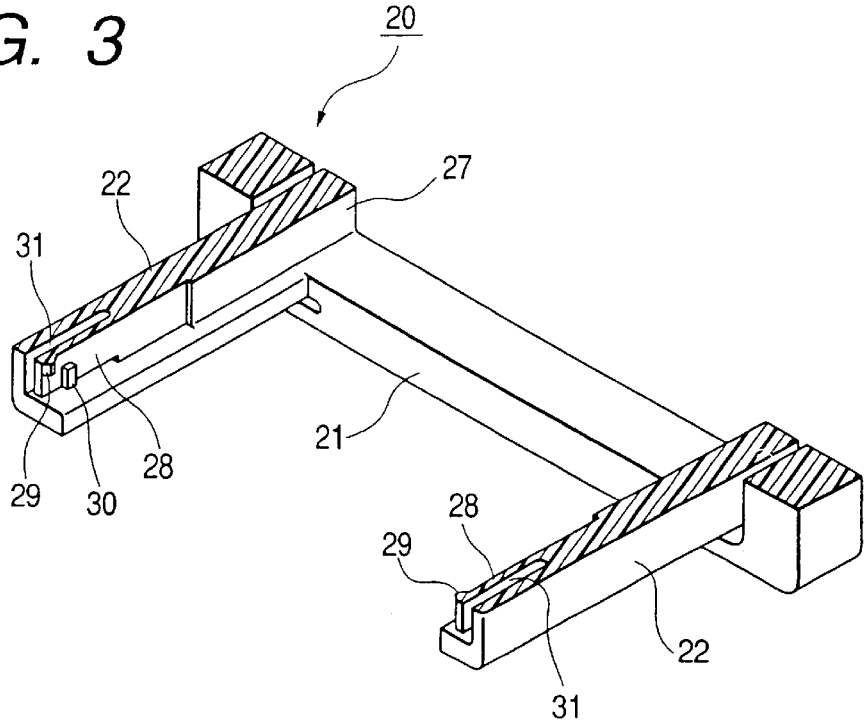
FIG. 3 is a partially cutout perspective view of a holder.
Figure 4:
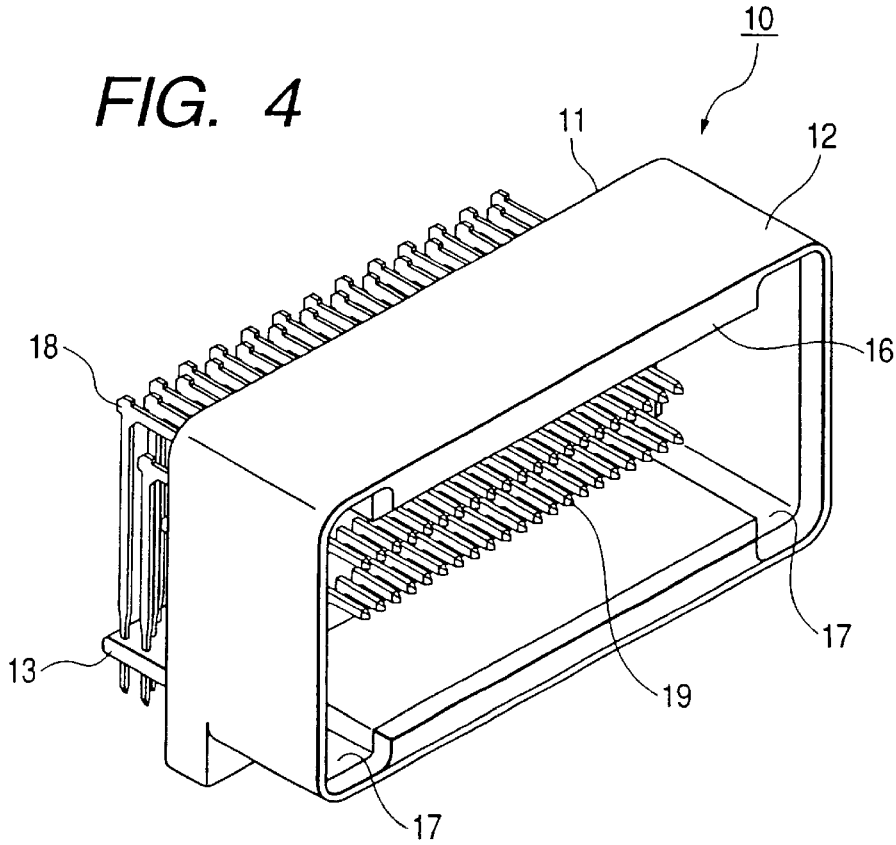
FIG. 4 is a perspective view showing a male side housing.
Figure 5:
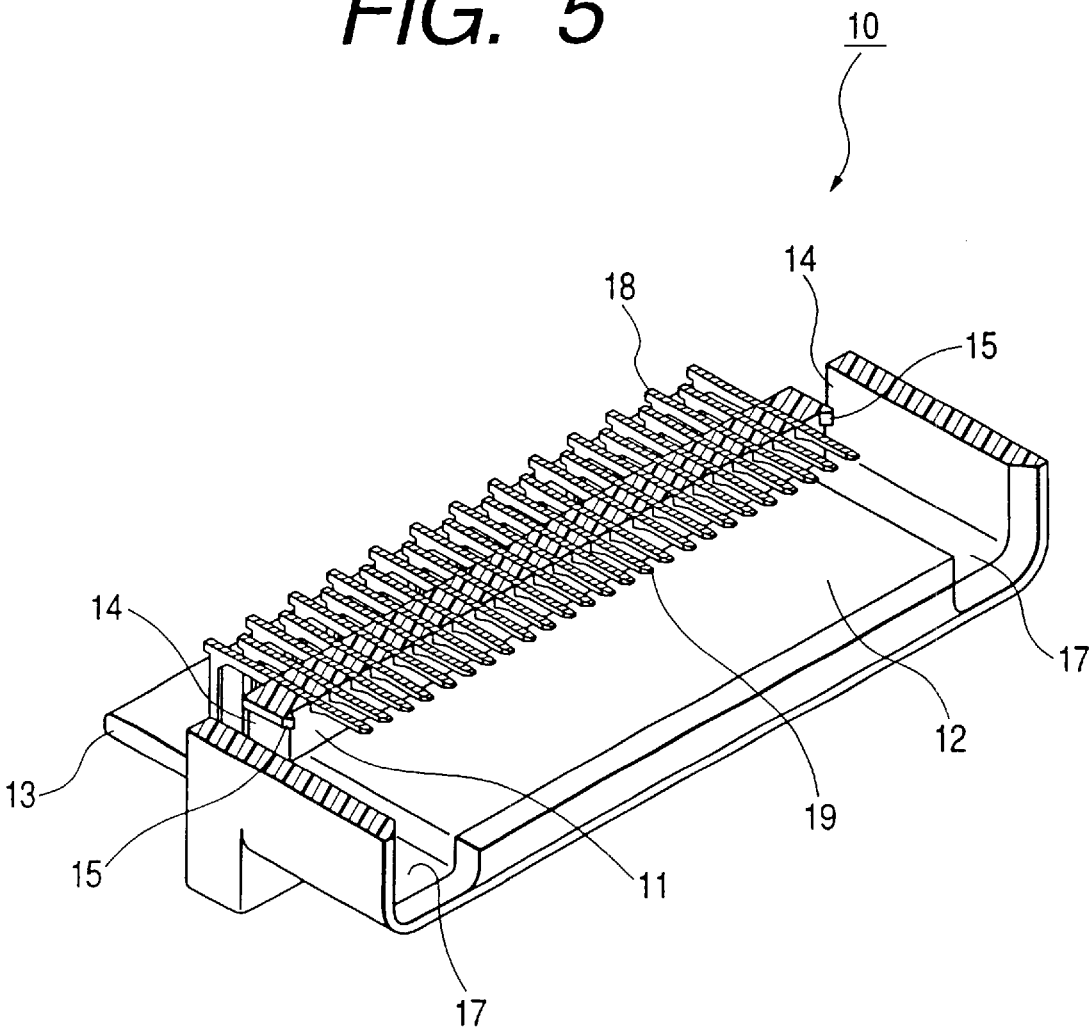
FIG. 5 is a partially cutout perspective view of a male side housing.

Referring to FIGS. 1 to 18, Embodiment 1 of the present invention will be explained below.

An outline of the connector of this embodiment will be described as follows. The connector includes: a male side housing 10 (stationary side housing which is a constituent element of the present invention) having a male terminal metal fitting 18 (stationary side terminal metal fitting which is a constituent element of the present invention); a female side housing 40 (movable side housing which is a constituent element of the present invention) having a female terminal metal fitting 50 (movable side terminal metal fitting which is a constituent element of the present invention); and a holder. The male side housing 10 is fixed to, for example, stationary member A such as a dashboard composing a meter module of an automobile. The female side housing 40 is attached to the holder 20 in such a manner that the female side housing 40 can be relatively displaced with respect to the holder 20. The holder 20 is fixed to, for example, attachment member B such as an instrument panel composing a meter module of an automobile. When this attachment member B is assembled to stationary member A, the holder 20 is incorporated into the male side housing 10, and at the same time the male terminal metal fitting 18 and the female terminal metal fitting 50 are connected with each other being electrically continued to each other.

The male side housing 10 is made of synthetic resin. The male side housing 10 includes: a substantially square support wall section 11 into which the horizontal section of an L-shaped narrow and slender male terminal metal fitting 18 is penetrated by means of press-fitting; a substantially square hood section 12 protruding forward (in a direction to the female side housing 40 and holder 20) from the outer peripheral edge of the support wall section 11; and a sheet-shaped positioning section 13 extending backward from the lower edge of the support wall section 11, the perpendicular section of the male terminal metal fitting 18 penetrating the sheet-shaped positioning section 13.

At both end portions of the support wall section 11, there are provided a pair of escape holes 14 extending in the vertical direction along the inner wall of the hood section 12. In the inner face lower end section of the escape hole 14 on the support wall section 11 side, there is provided a release section 15 engaged with the elastic deflection piece 28 of the holder 20 which will be described later. At the front edge of the upper wall of the hood section 12, there is provided a stopper 16 (initial position returning means which is a constituent element of the present invention) extending downward (inward) like a rib and also extending in the traverse direction. At both end sections of the upper and the lower face on the inner circumference of the hood section 12, there are provided recesses 17 which continue to the escape hole 14.

The holder 20 made of synthetic resin includes: a square frame section 21; and a pair of arm sections 22 extending forward (in a direction to the male side housing 10) from both side edge sections of the frame section 21, the pair of arm sections 22 extending like a longitudinal sheet-shape, wherein the square frame section 21 and the pair of arm sections 22 are integrally molded. The holder 20 is assembled to the male side housing 10 in such a manner that both the arm sections 22 are slid on the inner face of the hood section 12 and penetrated into the escape holes 14 without rattling. That is, the assembling direction of the holder 20 with respect to the male side housing 10 is a longitudinal direction which is parallel with the extending direction of the hood section 12 and the arm section 22.

On the inner faces of both the arm sections 22, there are provided a first cam groove 23*a* (guide means which is a constituent element of the present invention) and a second cam groove 23*b* (guide means which is a constituent element of the present invention) . The first cam groove 23*a* is arranged at an upper portion of the arm section 22. The first cam groove 23*a* is arranged being a little oblique with respect to the assembling direction of the holder 20 to the male side housing 10, and the width of this first cam groove 23*a* is kept constant. That is, the connecting position side end section 25 of the arm section 22 is located at an obliquely upper rear position with respect to w the initial position side end section 24 close to the extending end of the arm section 22 of the first cam groove 23*a*. Concerning the inclination angle of the first cam groove 23*a*, a distance in the longitudinal direction (direction parallel with the assembling direction of the holder 20 with respect to the male side housing 10) is much larger than a distance in the vertical direction (direction perpendicular to the assembling direction of the holder 20 with respect to the male side housing 10). The second cam groove 23*b* is formed in such a manner that the first cam groove 23*a* is moved in parallel to an obliquely rear lower position. The positional relation of the initial position side end section 24 with the connecting position side end section 25 is the same as that of the first cam groove 23*a*, and the sizes between both the end sections 24, 25 in the longitudinal direction and the vertical direction are the same as those of the first cam groove 23*a*. As described above, in the holder 20, two cam grooves, one is the first cam groove 23*a* and the other is the second cam groove 23*b*, are arranged in such a manner that they are shifted in an oblique direction with respect to the assembling direction of the holder 20 to the male side housing 10.

Further, in the arm section 22, there are provided a first idly engaging groove 26*a* and a second idly engaging groove 26*b* which are respectively continued to the first cam groove 23*a* and the second cam groove 23*b*. The first idly engaging groove 26*a* and the second idly engaging groove 26*b* are formed as follows. The first idly engaging groove 26*a* and the second idly engaging groove 26*b* continue to the connecting position side end sections 25 in the cam grooves 23*a*, 23*b*. (In this case, the connecting position side end sections 25 are end sections at which the cam pins 41*a*, 41*b*, are located when the female side housing 40 reaches the connecting position.) The first idly engaging groove 26*a* and the second idly engaging groove 26*b* extend from the connecting position side end sections 25 backward in parallel with the assembling direction of the attachment member B with respect to stationary member A and get to the window hole 27 of the frame section 21.

At the inner side lower end section of the extending end section (front end section) of each arm 22, there is provided an elastic deflection piece 28 (holding means which is a constituent element of the present invention). The elastic deflection piece 28 is formed in such a manner that an intermediate portion of the arm section 22 in the thickness direction is recessed so that the elastic deflection piece 28 is extended forward along the inner face of the arm section 22 like a cantilever. Therefore, the elastic deflection piece 28 can be elastically deformed outside. At the extending end (front end) of this elastic deflection piece 28, there is provided a receiving protrusion 29 for releasing, and there is also provided a receiving protrusion 30 for holding which is located at an obliquely lower rear position with respect to this receiving protrusion 29 for releasing. The receiving protrusion 30 holds the female side housing 40, which is located at the initial position, so that the female side housing 40 can not be displaced backward (connecting position side) with respect to the holder 20. When the releasing section 15 of the male side housing 10 comes into contact with the receiving protrusion 29 for releasing under the above holding condition, the elastic deflection piece 28 is elastically deflected into the recess 31 formed outside. Due to this elastic deflection, the holding state by the receiving protrusion 30 for holding can be released.

The female side housing 40 is made of synthetic resin and entirely formed into a block-shape. On the right and the left outer face of the female side housing 40, there are provided a first cam pin 41*a* and a second cam pin 41*b*, which are protruded. The respective cam pins 41*a*, 41*b* are slidably engaged with the cam grooves 23*a*, 23*b* and the idly engaging grooves 26*a*, 26*b* without rattling. The positional relation of the first cam pin 41*a* with the second cam pin 41*b* is the same as the positional relation of the first cam groove 23*a* with the second cam groove 23*b*. The second cam pin 41*b* is located at an obliquely lower rear position with respect to the first cam pin 41*a*. Accordingly, when the first cam pin 41*a* is located at the initial position side end section 24 of the first cam groove 23*a*, the second cam pin 41*b* is located at the initial position side end section 24 of the second cam groove 23*b*. When the first cam pin 41*a* is located at the connecting position end section 25 of the first cam grooves 23*a*, the second cam pin 41*b* is located at the connecting position side end section 25 of the second cam groove 23*b*. Therefore, while both the cam pins 41*a*, 41*b* are moving between both the end sections 24, 25, the female side housing 40 keeps a constant posture with respect to the holder 20. While the first cam pin 41*a* and the second cam pin 41*b* are respectively moving in the first idly engaging groove 26*a* and the second engaging groove 26*b*, the posture of the female side housing 40 is not changed.

When both the cam pins 41*a*, 41*b* are engaged with the initial position side end section 24, the female side housing 40 is located at the initial position of the front end section (forward side end section in the assembling direction with respect to the male side housing 10) of the holder 20. Therefore, when both the cam pins 41*a*, 41*b* are engaged with the connecting position side end section 25, the female side housing 40 is located at a connecting position behind the initial position. The female side housing 40 is displaced obliquely with respect to the assembling direction between the initial position and the connecting position by the guide means composed of the cam grooves 23*a*, 23*b* and the cam pins 41*a*, 41*b* while the posture is being kept constant.

There are provided protrusions 42 for holding and engaging at the front end lower end positions on both sides of the female side housing 40. When these protrusions 42 for holding and engaging are engaged with the receiving protrusions 30 for holding of the holder 20, the female side housing 40, which is located at the initial position, is held so that it can not be displaced onto the connecting position side. In the middle of assembling the holder 20 to the male side housing 10, when the releasing section 15 of the male side housing 10 elastically deflects the elastic deflection piece 28 outside, the receiving protrusion 30 for holding is released from the engaging protrusion 42 for holding, so that the holding state can be released.

In the female side housing 40, there is provided a female terminal metal fitting 50. The female terminal metal fitting 50 is provided with an engaging section 51, the profile of which is a long square tube which is engaged with the tab 19 of the male terminal metal fitting 18. In this engaging section 51, there is provided an elastic contact piece 53 which is formed by raising a portion of the side wall 52. The elastic contact piece 53 is arranged at a position of approximately lower half of the engaging section 51 in the direction of height. The elastic contact piece 53 protrudes inside from the side wall 52 and extends in the longitudinal direction (in the direction parallel with the assembling direction of the holder 20 with respect to the male side housing 10). At the upper edge of the elastic contact piece 53, there is provided a tapered induction section 54. In an upper portion of the elastic contact piece 53 in the engaging section 51, there is provided an accommodation space 55 for accommodating the tab 19 of the male terminal metal fitting 18 under the condition that the tab 19 does not come into contact with the elastic contact piece 53 or the tab 19 lightly comes into contact with the elastic contact piece 53 so that the elastic contact piece 53 can not be elastically deformed.

In the process of assembling the holder 20 to the male side housing 10 (when the arm section 22 is engaged with the hood section 12 or the escape hole 14), when the female side housing 40 is located at the initial position, the elastic contact piece 53 of the female terminal metallic fitting 50 is disconnected downward (in a direction perpendicular to the assembling direction) from the tab 19 of the male terminal metallic fitting 18, that is, the elastic contact piece 53 of the female terminal metallic fitting 50 is in a state in which connection can not be accomplished. When the female side housing 40 is located at the connecting position, the elastic contact piece 53 of the female terminal metallic fitting 50 can be connected with the tab 19, that is, the elastic contact piece 53 of the female terminal metallic fitting 50 is in a state in which connection can be accomplished (The elastic contact piece 53 and the tab 19 are set at the same height.).

The height of the female side housing 40 is determined to be smaller than the interval between the inner circumferential lower face of the hood section 12 of the male side housing 10 and the lower end face of the stopper 16. Due to the above difference in the size, the female side housing 40 is allowed to move in the vertical direction in the hood section 12. This allowed movable size in the vertical direction is equal to the difference in the height between the initial position and the connecting position. On the upper face of the female side housing 40, there is provided an engaging rib 43 (initial position returning means which is a constituent element of the present invention) which is arranged in the longitudinal direction. In this connection, the protruding height of this engaging rib 43 is the same as the movable size in the vertical direction between the initial position and the connecting position of the female side housing 40. When the front end face of the female side housing 40 comes into contact with the support wall section 11 of the male side housing 10, this engaging rib 43 can engage with the stopper 16 of the male side housing 10 at the rear. Under the condition that the female side housing 40 collides with the male side housing 10, when the female side housing 40 is located at an upper position of the initial position, that is, when the female side housing 40 is located on the connecting position side, the engaging rib 43 engages with the stopper 16. Due to the foregoing, the female side housing 40 is prevented from moving idly in a direction, so that the female side housing 40 can not be disengaged from the male side housing 10.

At the upper face rear end of this engaging rib 43, there is provided a semi-lock protrusion 44 (semi-lock means which is a constituent element of the present invention). This semi-lock protrusion 44 engages with the lower end of the stopper 16 under the condition that the female side housing 40 is located at the initial position. However, since the engaging area is small and further the profile of the semi-lock protrusion 44 is triangular, it is possible to restrict the female side housing 40 from idly moving in the disengaging direction with respect to the male side housing 10. However, when a disengaging force, the intensity of which is not less than a predetermined value, is given to the semi-lock protrusion 44, the restriction to restrict an idle movement of the housing by the engagement between the semi-lock protrusion 44 and the stopper 16 is released. Therefore, while the female side housing 40 is following the holder 20, the female side housing 40 is allowed to be displaced in the disengaging direction from the male side housing 10.

In this connection, when the restriction to restrict an idle movement, which is conducted by the semi-lock protrusion 44 and the stopper 16, is released, the female side housing 40 is integrally displaced in the disengaging direction while the female side housing 40 is made to follow the holder 20 by utilizing the movement of the holder 20 which is disengaged from the male side housing 10. As the following means, the inner faces of the initial position side end sections 24 of the cam grooves 23*a*, 23*b* are engaged with the outer faces of the cam pins 41*a*, 41*b*. That is, the initial position side end sections 24 and the cam pins 41*a*, 41*b* are provided with a function of the engaging means of the present invention.

Next, the action of the present embodiment will be explained below.

Figure 6:
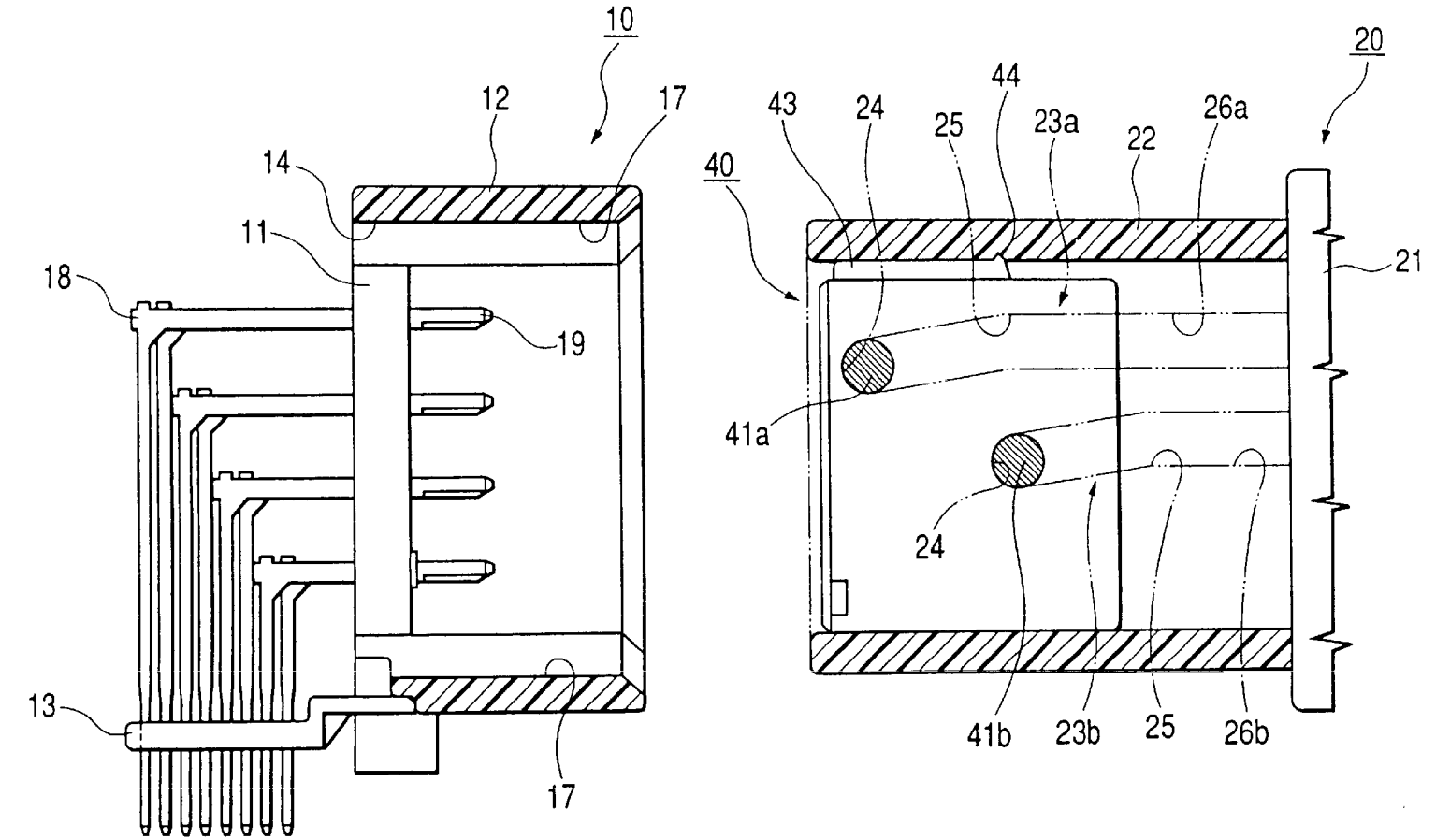
FIG. 6 is a cross-sectional view showing a state in which a holder is disengaged from a male side housing.
Figure 10:
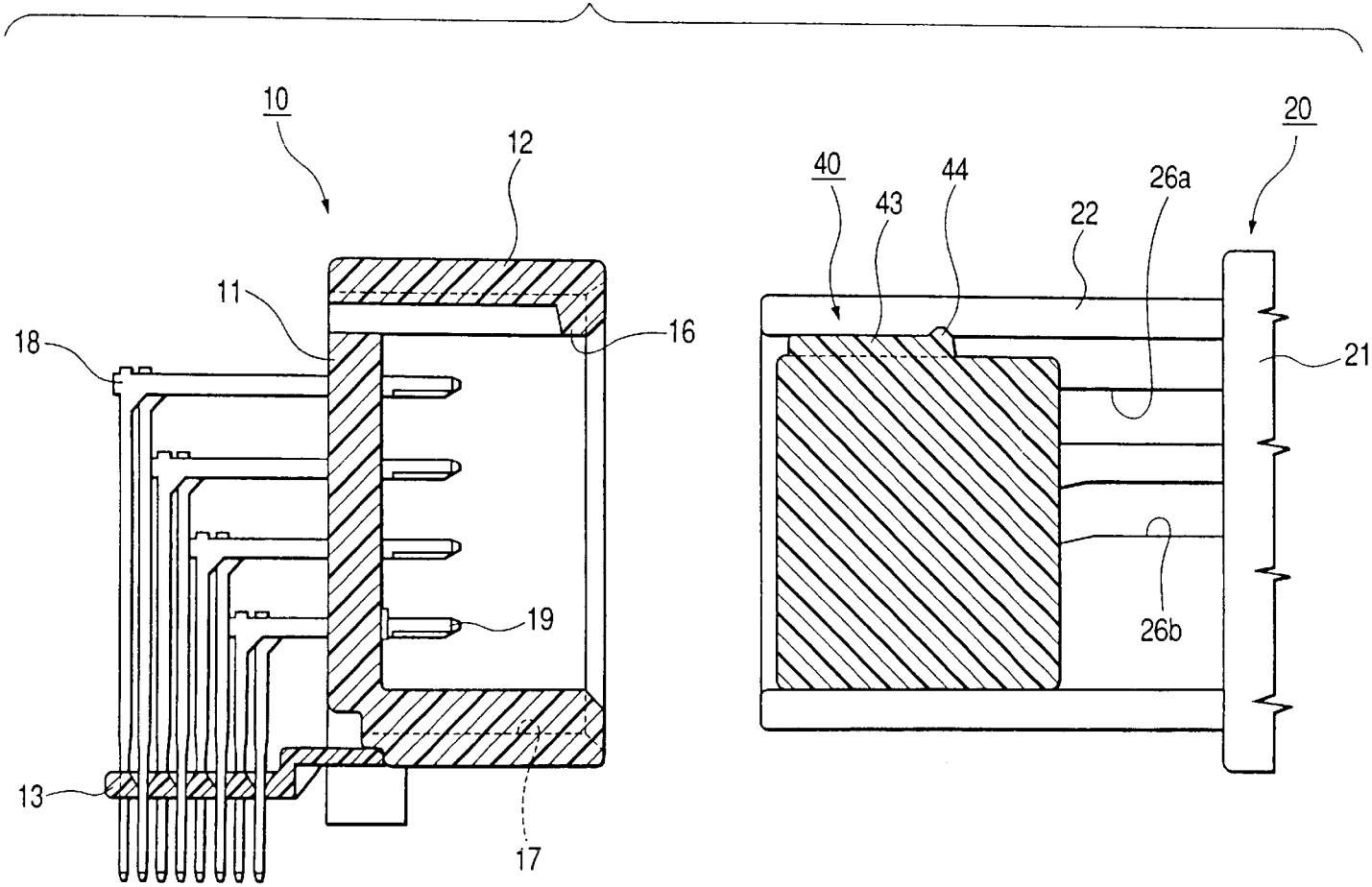
FIG. 10 is a cross-sectional view showing a state in which a holder is disengaged from a male side housing.
Figure 15A:
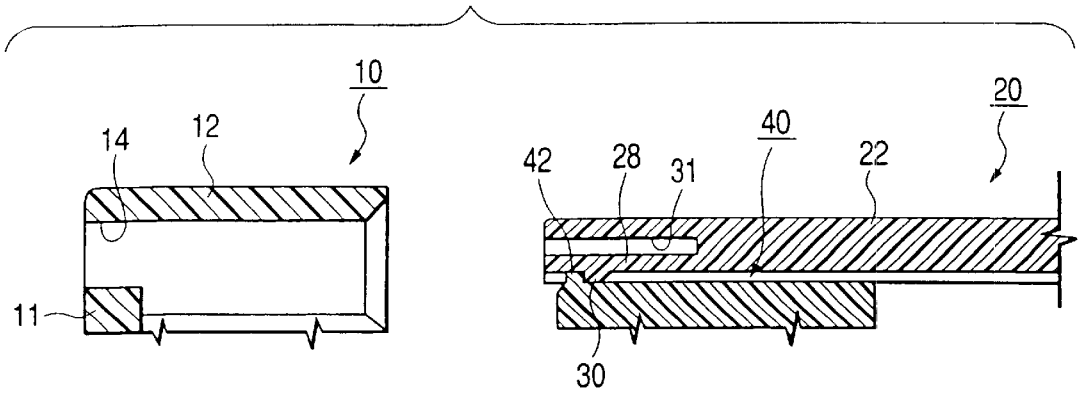

First, the female side housing 40 is inserted into the window hole 27 of the holder 20. While the cam pins 41*a*, 41*b* are respectively being engaged with the idly engaging grooves 26*a*, 26*b*, they are engaged between both the arm sections 22. Further, the cam pins 41*a*, 41*b* are engaged in the cam grooves 23*a*, 23*b* and moved to the initial position. At this time, the engaging protrusion 42 for holding the female housing 40 elastically deflects the elastic deflection piece 28 of the holder 20 and passes through the receiving protrusion 30 for holding. When the female side housing 40 reaches the initial position, the elastic deflection piece 28 elastically returns and the receiving protrusion 30 for holding engages with the engaging protrusion 42 for holding. Due to the foregoing, the female side housing 40 is held at the initial position, so that an idle movement onto the connecting position side can be restricted as shown in FIGS. 6, 10 and 15A.

Figure 7:
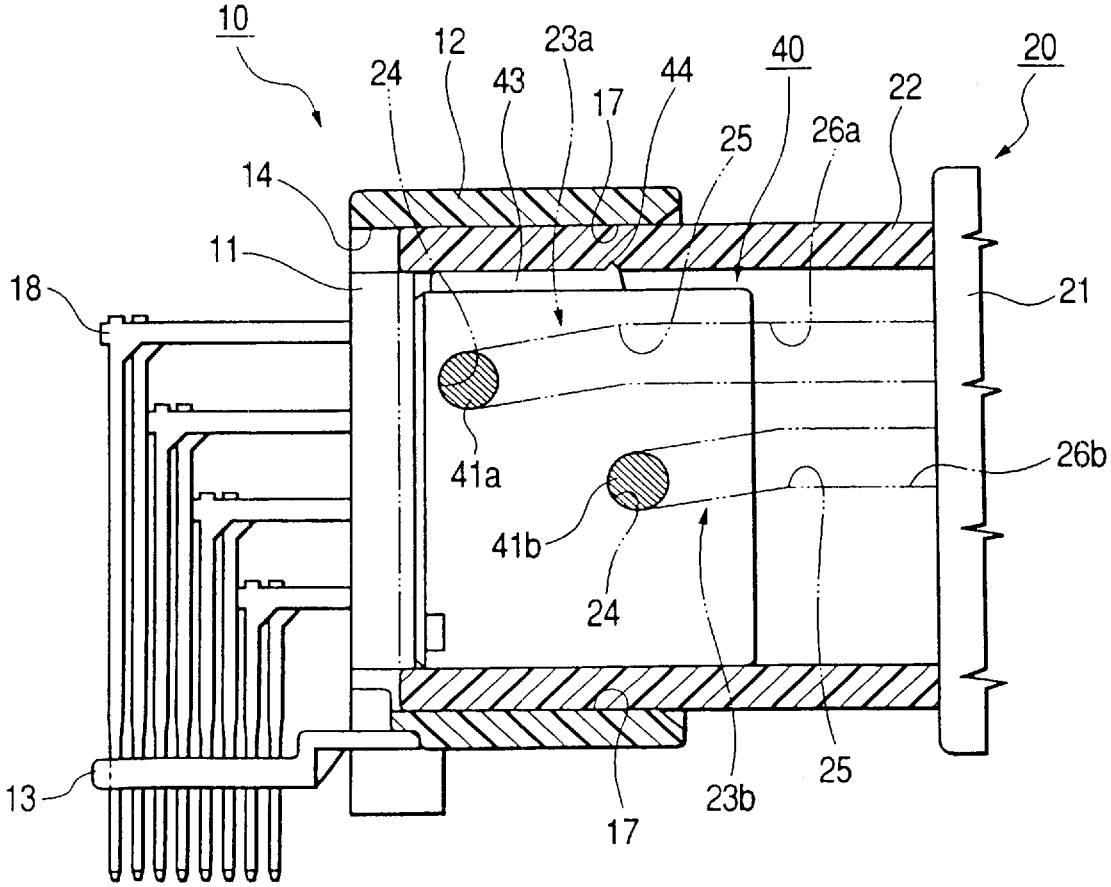
FIG. 7 is a cross-sectional view showing a state in the middle of assembly of a holder to a male side housing.
Figure 11:
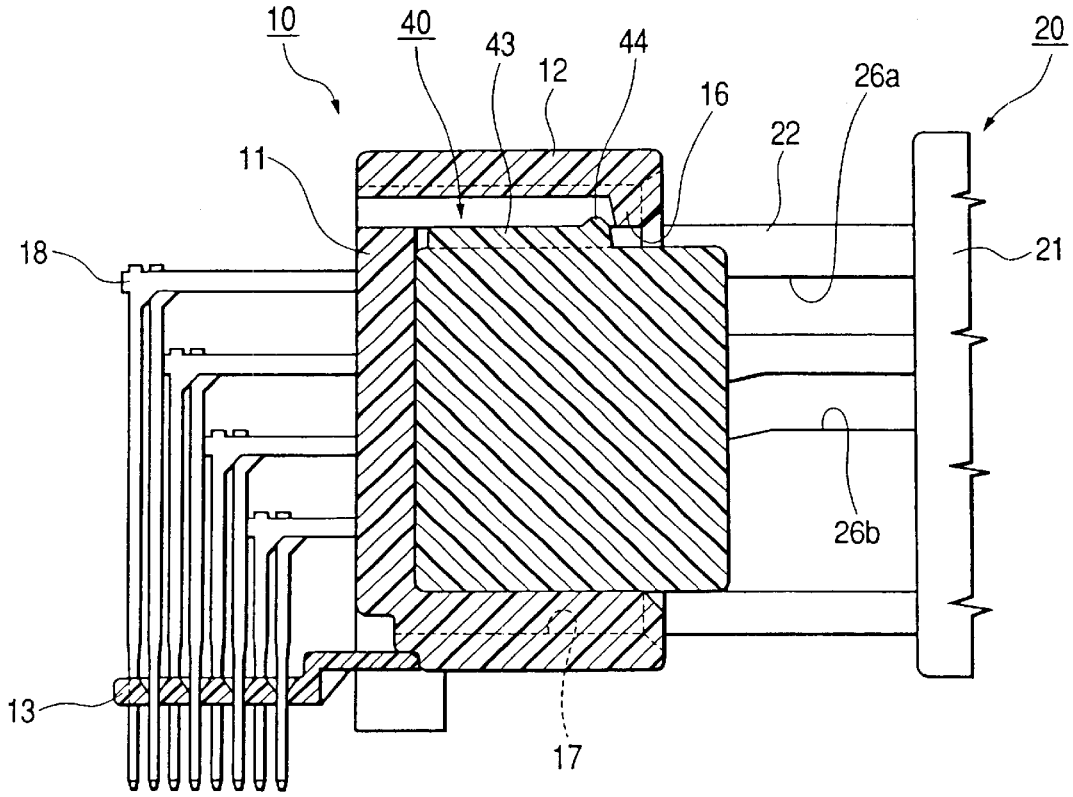
FIG. 11 is a cross-sectional view showing a state in the middle of assembly of a holder to a male side housing.
Figure 14:
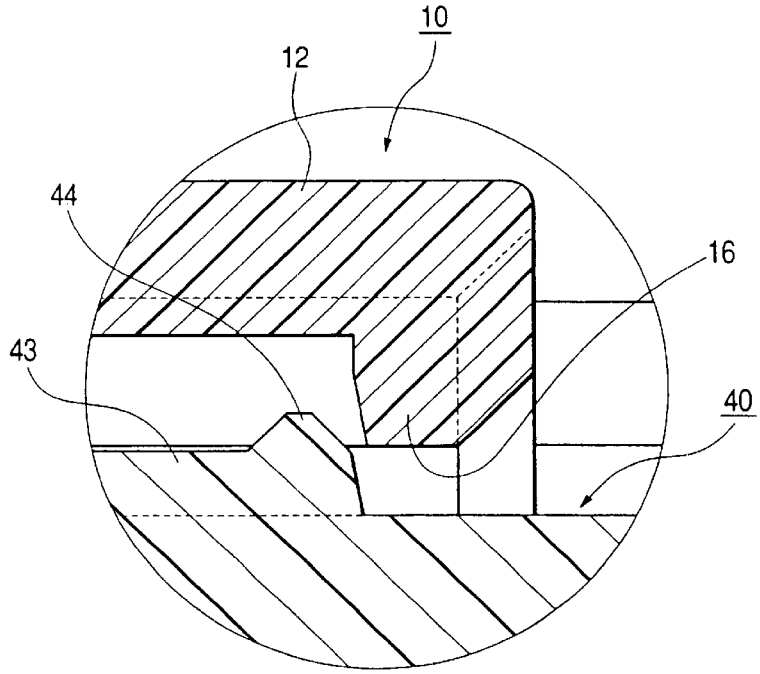
FIG. 14 is a partially enlarged cross-sectional view showing a state of restricting an idle motion by a semi-lock means.
Figure 15B:
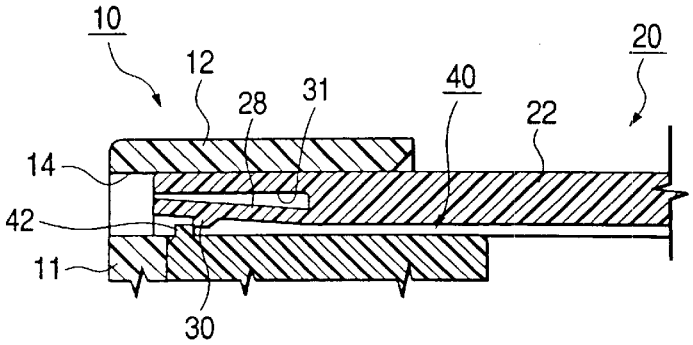
Figure 15C:
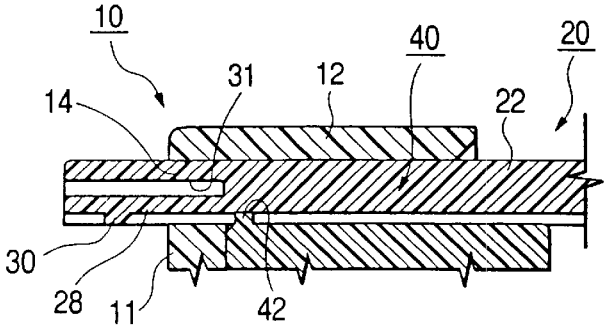
Figure 15D:
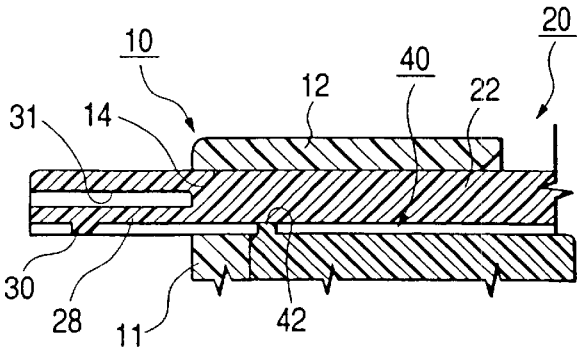
Figure 16A:
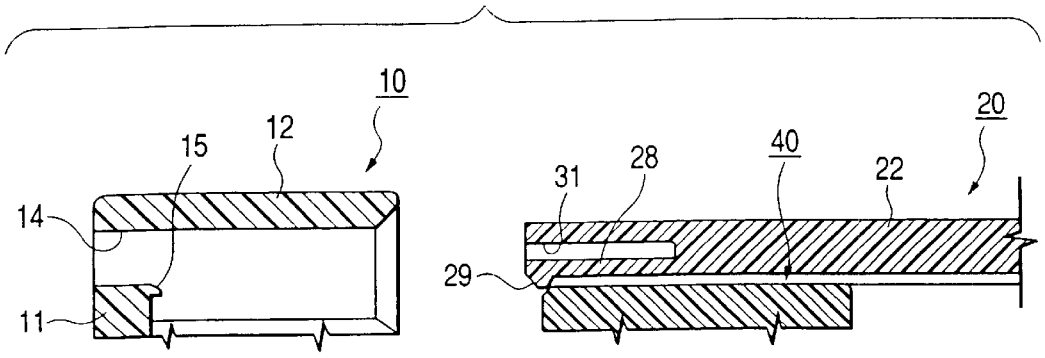
Figure 16B:
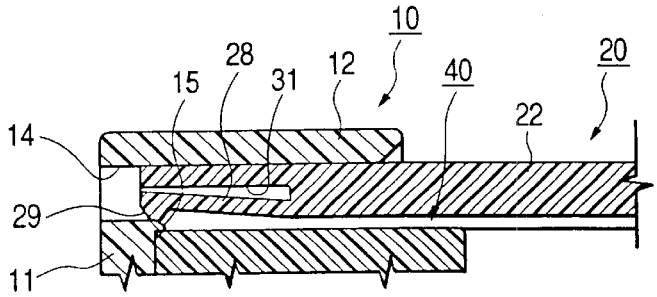
Figure 16C:
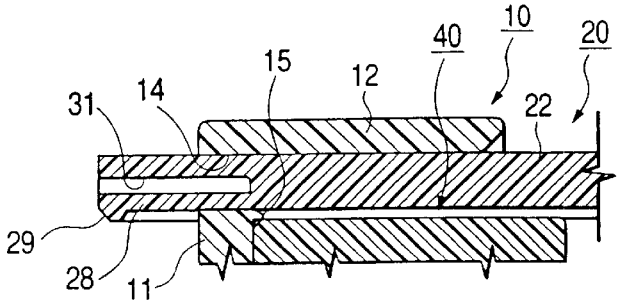
Figure 16D:
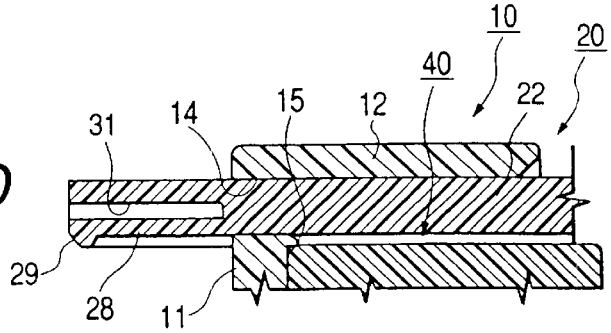
Figure 17A:
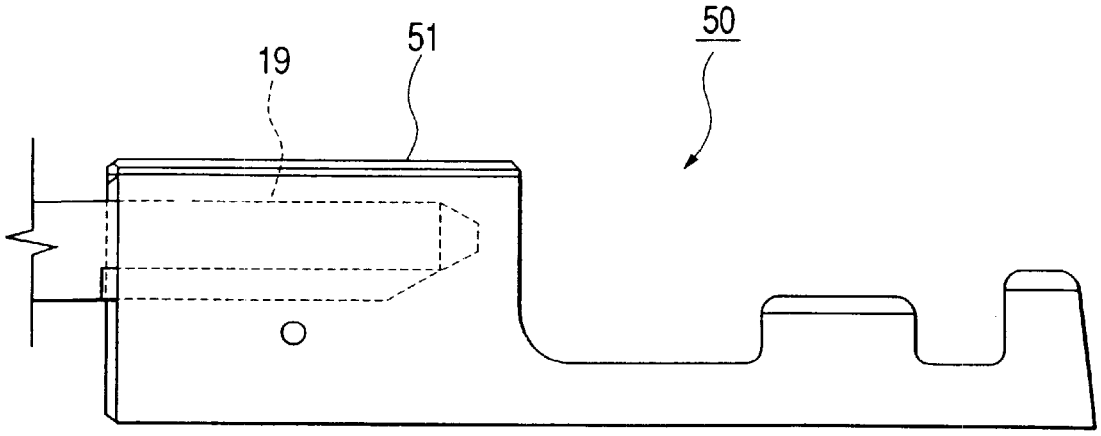
Figure 17B:
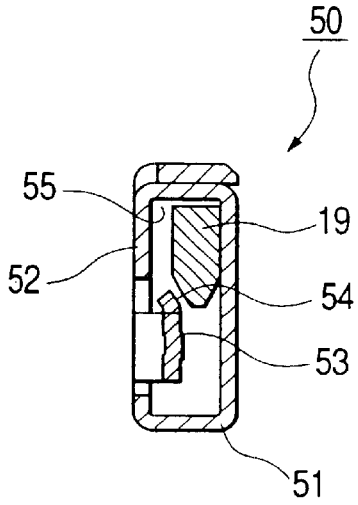

Under the above condition, attachment member B is assembled to stationary member A. Then, the arm section of the holder 20 is engaged in the hood section 12 of the male side housing 10, and the female side housing 40 collides with the support wall section 11 of the male side housing 10 as shown in FIGS. 7 and 11. At this time, the semi-lock protrusion 44 displaces an upper wall section of the hood section 12 a little upward and passes through the stopper 16. Therefore, the semi-lock protrusion 44 engages with the stopper 16 as shown in FIG. 14. When both the housings 10, 40 come into contact with each other, the releasing section 15 of the male side housing 10 elastically deflects the elastic deflection piece 28 of the holder 20 outside, so that the holding condition of the female side housing 40 can be released. Therefore, the female side housing 40 can be displaced from the initial position to the connecting position side relatively to the holder 20 as shown in FIGS. 15B and 16B. When both the housings 10, 40 collide with each other, the tab 19 of the male terminal metal fitting 18 gets into the engaging section 51 of the female terminal metal fitting 50. However, since the female side housing 40 is located at the initial position and the tab 19 is located in the accommodation space 55 provided on the upper side of the engaging section 51, the tab 19 and the elastic contact piece 53 are not set in a normal connecting state as shown in FIG. 17.

Figure 8:
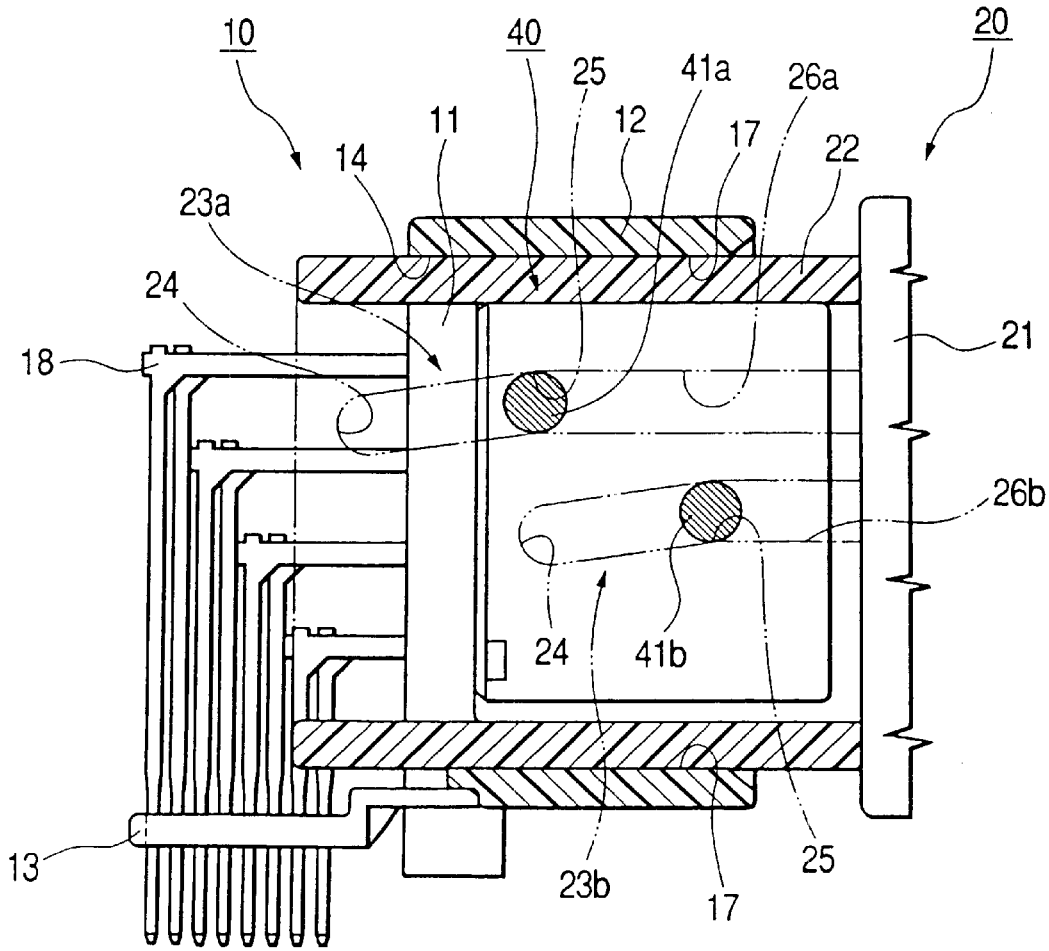
FIG. 8 is a cross-sectional view showing a state in which a female side housing is displaced to a connecting position in the middle of assembly of a holder.
Figure 12:
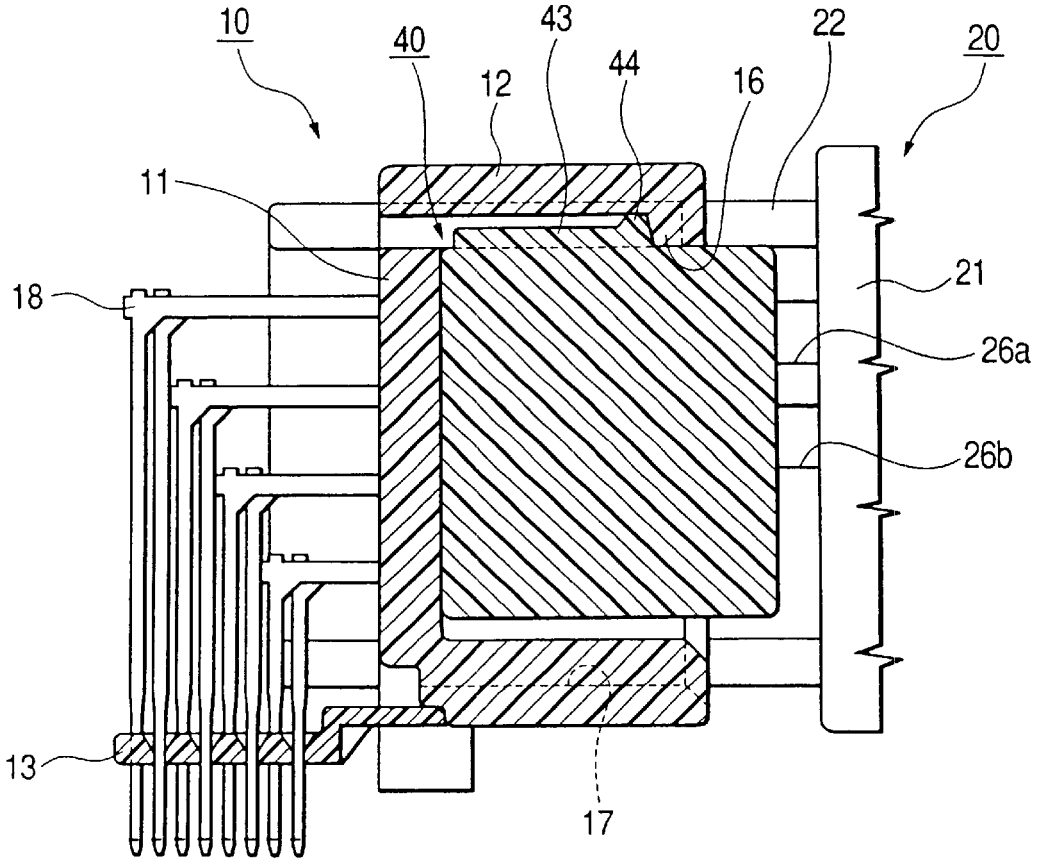
FIG. 12 is a cross-sectional view showing a state in which a female side housing is displaced to a connecting position in the middle of assembly of a holder.
Figure 13:
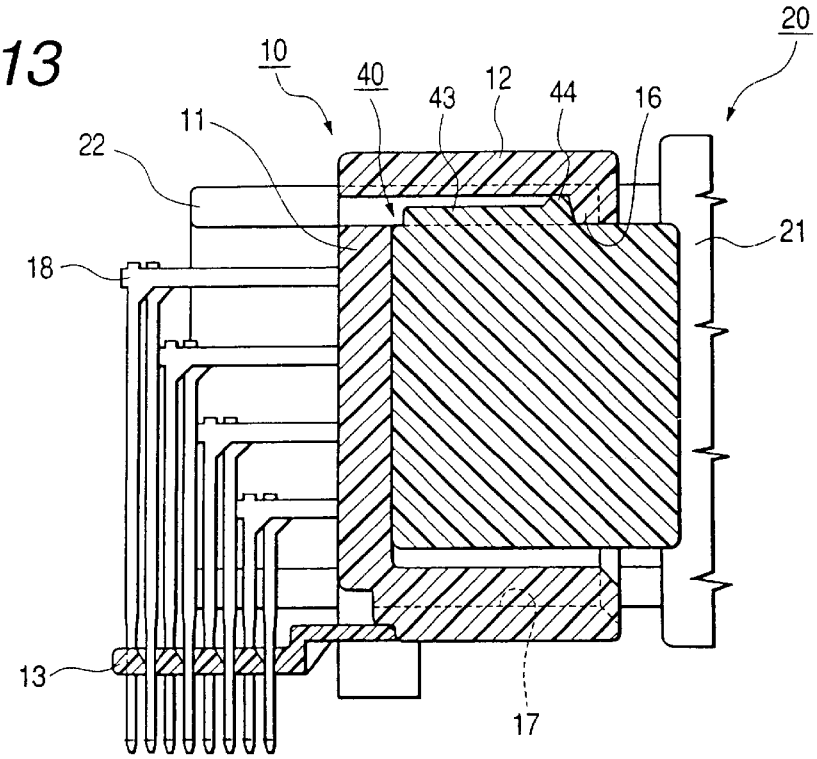
FIG. 13 is a cross-sectional view showing a state in which the assembly of a holder to a male side housing is completed.

When the assembling work of the holder 20 to the male side housing 10 further proceeds, the female side housing 40, which is restricted from moving to the assembling direction because the female side housing 40 collides with the male side housing 10, is relatively displaced backward with respect to the holder 20. Therefore, the female side housing 40 is displaced to the connecting position by the guide function exerted by the engagement of the cam pins 41*a*, 41*b* with the cam grooves 23*a*, 23*b* as shown in FIGS. 8 and 12. In this displacement motion from the initial position to the connecting position, the female side housing 40 is relatively moved obliquely upward backward in the holder 20. However, in the male side housing 10, the female side housing 40 is moved upward in a direction perpendicular to the assembling direction of the holder 20. That is, the female side housing 40 is moved upward in the hood section 12 and the engaging rib 43 is engaged with the stopper 16.

Figure 9:
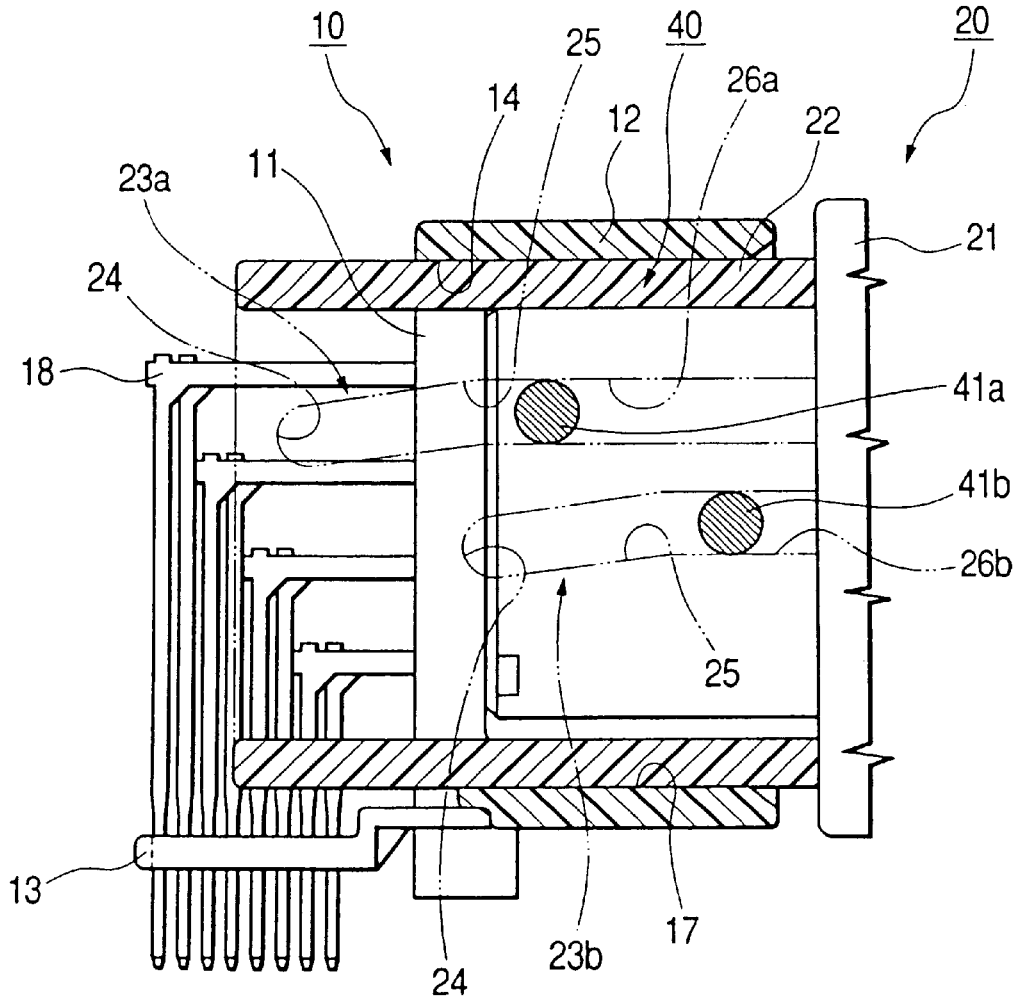
FIG. 9 is a cross-sectional view showing a state in which the assembly of a holder to a male side housing is completed.

At the point of time when the female side housing 40 reaches the connecting position, the attaching work of attachment member B to stationary member A has not been completed yet, and the assembly work of the holder 20 to the male side housing 10 has not been completed, either. The attaching motion and the assembly motion further proceed. When the cam pins 41*a*, 41*b* pass through the connecting position side end sections 25 of the cam grooves 23*a*, 23*b* and move into the idly engaging grooves 26*a*, 26*b*, so that they can be put into the normal attaching and assembling condition, the cam pins 41*a*, 41*b* are located in the middle of the idly engaging grooves 26*a*, 26*b* as shown in FIG. 9. In this connection, since the idly engaging grooves 26*a*, 26*b* are parallel with the assembling direction of the holder 20, the female side housing 40 is not moved vertically while the cam pins 41*a*, 41*b* are moving in the idly engaging grooves 26*a*, 26*b*.

Figure 18A:
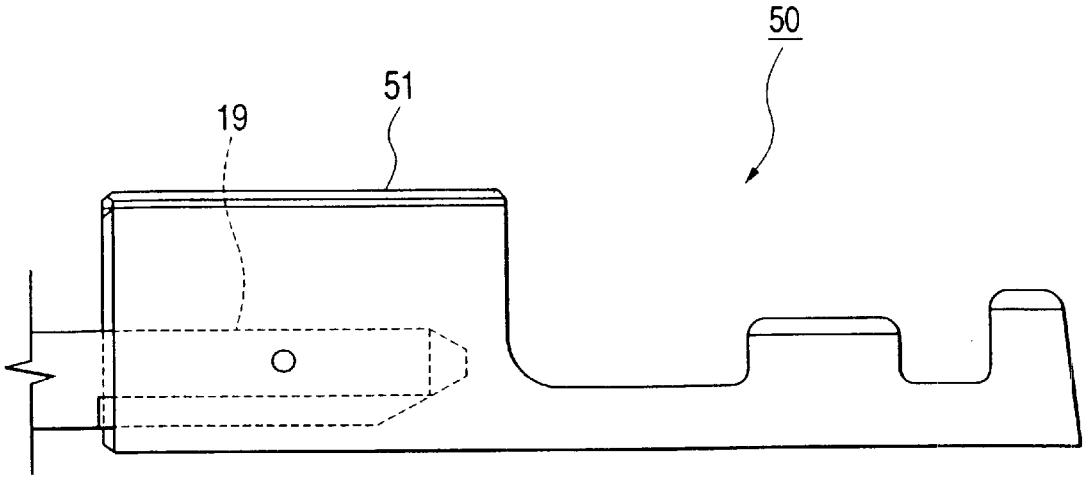
Figure 18B:
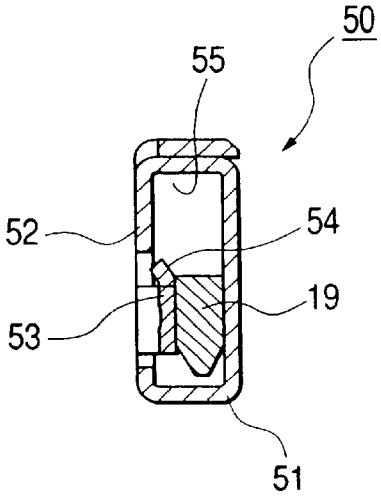

As described above, while the female side housing 40 is moved upward from the initial position to the connecting position without being moved in the longitudinal direction with respect to the male side housing 10, the tab 19 of the male terminal metal fitting 18, which is inserted into the accommodation space 55 in the engaging section 51 of the female terminal metal fitting 50, is moved downward relatively to the engaging section 51, so that the elastic contact piece 53 is elastically deflected for connection as shown in FIG. 18. Due to the foregoing, the connection of the terminal metal fittings 18, 50 is completed, and also the engagement of the housings 10, 40 is completed.

Next, the process of disengagement of both the housings will be explained below.

When attachment member B is separated from stationary member A, the holder 20 is displaced in a direction so that the holder 20 is separated from the male side housing 10. At the beginning of the displacement motion, since the cam pins 41*a*, 41*b* are engaged with the idly engaging grooves 26*a*, 26*b*, the female side housing 40 is kept at a height so that the engaging rib 43 can be engaged with the stopper 16. Accordingly, the female side housing 40 is not moved in the disengaging direction. When the disengagement of the holder 20 proceeds and the pins 41*a*, 41*b* are engaged with the cam grooves 23*a*, 23*b*, the female side housing 40 is displaced downward by the inclination of the cam grooves 23*a*, 23*b* while the female side housing 40 is being restricted by the stopper 16 so that it can not be disengaged. Immediately before the cam pins 41*a*, 41*a* reach the initial position side end section 24, only the semi-lock protrusion 44 is engaged with the stopper 16. Since the idle movement is restricted by the semi-lock protrusion 44 in this way, the female side housing 40 is returned to the normal initial position.

When the disengagement of the holder 20 further proceeds from this state, the initial position side end sections 24 are engaged with the cam pins 41*a*, 41*b*. Therefore, the female side housing 40 is displaced in the disengaging direction integrally with the holder 20. In this case, since the profile of the semi-lock protrusion 44 is formed triangular and the engaging area of the semi-lock protrusion 44 with the stopper 16 is small, the semi-lock protrusion 44 passes through the stopper 16 without causing any problems. Then, the holder 20 and the female side housing 40 are integrated into one unit and separated from the male side housing 10.

As described above, in the present embodiment, when the holder 20 is assembled to the male side housing 10 under the condition that the female side housing 40 is located at the initial position, the female side housing 40 comes into contact with the male side housing 10 in the process of assembly, and the female side housing 40 can not be further moved in the assembling direction. At this time, both the terminal metal fittings 18, 50 are kept in the non-engagement state. Therefore, the assembly resistance caused by the friction between the terminal metal fittings 18, 50 is not generated.

After that, while the female side housing 40 is being displaced from the initial position to the connecting position, both the terminal metal fittings 18, 50 are connected with each other. Then, a frictional resistance caused by the elastic restoring force of the elastic contact piece 53 is generated between the elastic contact piece 53 and the tab 19. This frictional resistance acts as a force resisting the displacement of the female side housing 40 to the connecting position side and also resisting the assembly of the holder 20. In this embodiment, the moving direction of the female side housing 40 from the initial position to the connecting position in the male side housing 10 is set to be perpendicular to the assembling direction of the holder 20, and further a cam action is exerted by the cam grooves 23*a*, 23*b*, which are oblique to the assembling direction of the holder 20, and the cam pins 41*a*, 41*b*. Therefore, an intensity of the operation force in the assembling direction to be given to the holder 20 can be reduced.

In the case where the female side housing 40 is moved to the connecting position when the holder 20 is assembled to the male side housing 10, the cam action caused between the cam grooves 23*a*, 23*b* and the cam pins 41*a*, 41*b* can not be utilized, and the elastic contact piece 53 and tab 19 are engaged in the same direction as the assembling direction of the holder 20. Accordingly, the frictional resistance between both the terminal metal fittings 18, 50 immediately acts as an assembly resistance. However, in this embodiment, the elastic deflection piece 28 of the holder 20 is engaged with the female side housing 40 so that the female side housing 40 can be held at the initial position. Therefore, the cam force can be effectively utilized, and the assembly operation force reducing function can be positively exerted.

It is possible to consider that a semi-lock structure is adopted as a means for holding the female side housing 40 at the initial position. In this case, problems may be caused in the reliability of the holding function. These problems are solved by the present embodiment as follows. In the present embodiment, there is provided a release section 15 for forcibly releasing the holding condition made by the elastic deflection piece 28, so that it can be positively held and released. Accordingly, the reliability of the holding function can be enhanced by increasing the engaging area of the elastic deflection piece 28.

In this embodiment, in the cam grooves 23*a*, 23*b*, there are provided idly engaging grooves 26*a*, 26*b* which extend in parallel with the attaching direction of attachment member B with respect to stationary member A. After the assembly has been completed, the cam pins 41*a*, 41*b* are engaged with the idly engaging grooves 26*a*, 26*b*. Due to the above structure, even if a positional relation fluctuates in the assembling direction between the holder 20 and the housing 10 which is caused by an assembly error between stationary member A and attachment member B, the cam pins 41*a*, 41*b* are kept in a range of the idly engaging grooves 26*a*, 26*b*. Therefore, a displacement in a direction perpendicular to the assembling direction of the female side housing 40 can be prevented, that is, an idle motion from the connecting position to the initial position side can be prevented. Accordingly, the connecting condition of the terminal metal fittings 18, 50 can be maintained.

The two cam grooves 23*a*, 23*b* are arranged in parallel with each other. Accordingly, there is no possibility that the female side housing 40 is tilted with respect to the male side housing 10. Further, both the cam grooves 23*a*, 23*b* are arranged being obliquely shifted in the assembling direction. Therefore, compared with a case in which the cam grooves are arranged being shifted in a direction parallel with the assembling direction or in a direction perpendicular to the assembling direction, the tilt prevention effect of this arrangement is high.

Since the stopper 16 provided in the male side housing 10 and the engaging rib 43 provided in the female side housing 40 are engaged with each other, the female side housing 40 can be positively returned to the initial position in the case of disengagement. Further, in a period from the time immediately before the female side housing 40 is returned to the initial position to the time when the female side housing 40 reaches the normal initial position, an idle motion of the female side housing 40 in the disengaging direction is restricted by the semi-lock protrusion 44. Accordingly, it is possible to positively return the female side housing 40 to the initial position without causing any problem in the disengaging motion of the female side housing 40 from the male side housing 10.

In the connector composed as described above, it is possible to reduce an intensity of the operation force required when it is engaged with the opponent connector. Therefore, this connector is preferably used as a connector for electrically connecting the unit parts of an automobile which are formed into a module. When this connector is utilized for the unit parts of an automobile which are formed into a module, the working property of assembly work can be enhanced, and further the working property of removing the parts in the case of dismembering an automobile for the purpose of recycling can be enhanced.

EMBODIMENT 2

Figure 19:
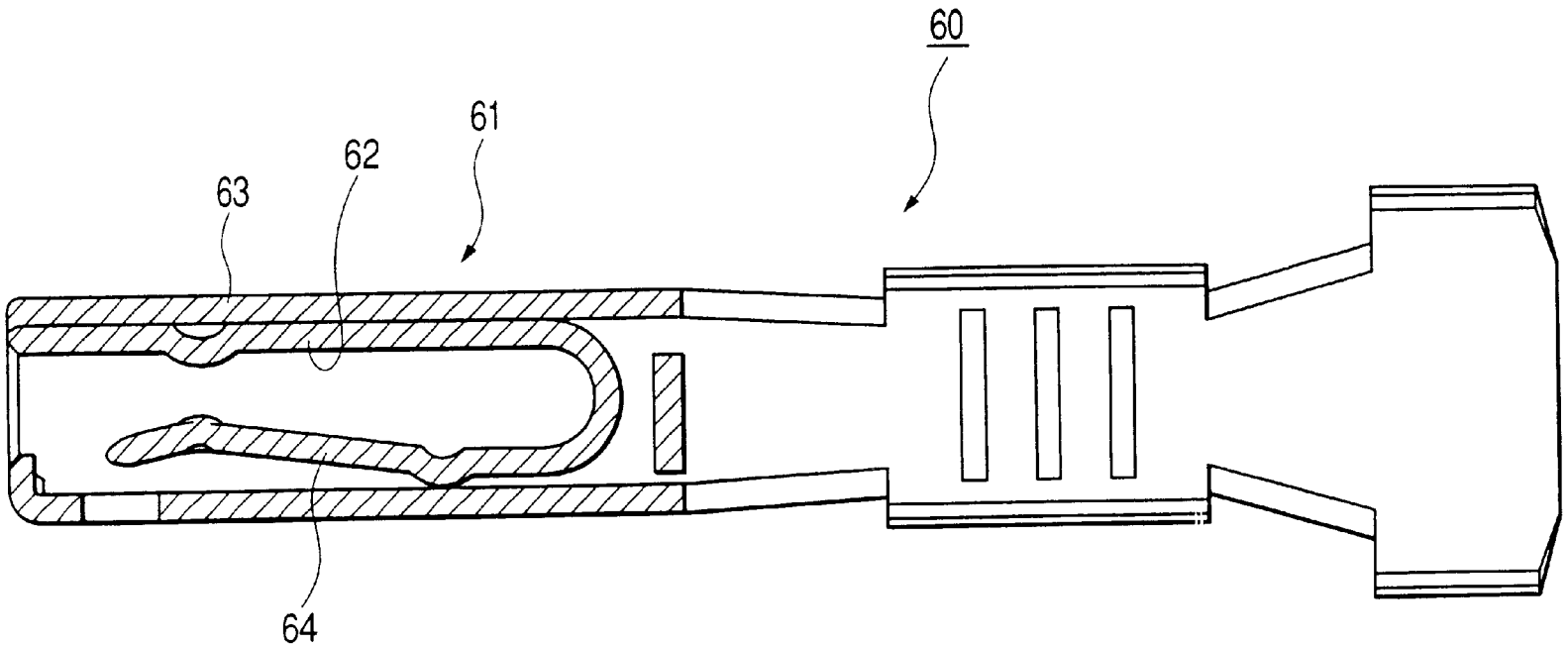
FIG. 19 is a partially cutout plan view showing a female terminal metal fitting of Embodiment 2.
Figure 20A:
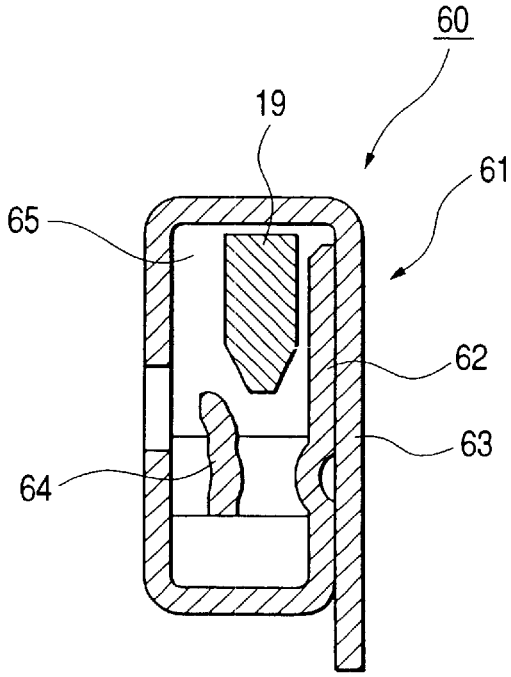
Figure 20B:
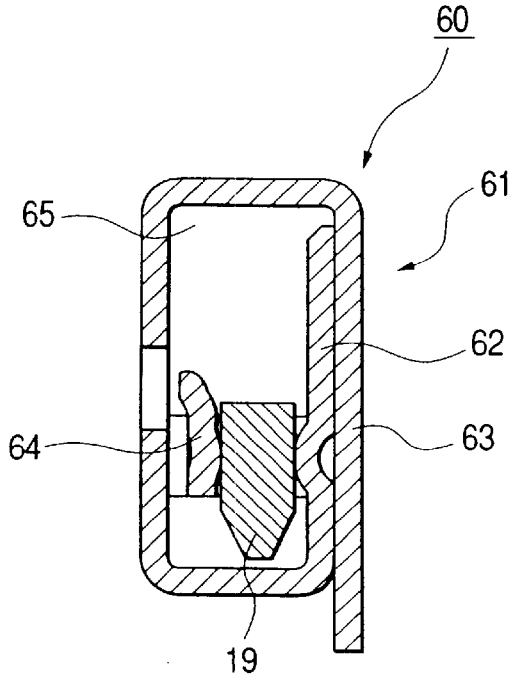

Next, referring to FIGS. 19 and 20, Embodiment 2 of the present invention will be explained below. The female terminal metal fitting 60 of this Embodiment 2 is different from that of the above Embodiment 1. Other points of the structure of Embodiment 2 are the same as those of Embodiment 1. Accordingly, like reference characters are used to indicate like parts in Embodiments 1 and 2, and the explanations of the structure, action and effect are omitted here.

The female terminal metal fitting 60 of Embodiment 2 is composed as follows. One side wall of the engaging section 61 is formed into a double plate structure composed of the side walls 62, 63. When a portion of the inner side wall 62, which extends backward, is folded back forward, the elastic contact piece 64 is formed. In an upper portion of the elastic contact piece 64 in the engaging section 61, there is provided an accommodation space 65 into which the tab 19 is inserted under the condition that the tab 19 does not come into contact with the elastic contact piece 64 when the female side housing 60 is located at the initial position.

EMBODIMENT 3

Figure 21A:
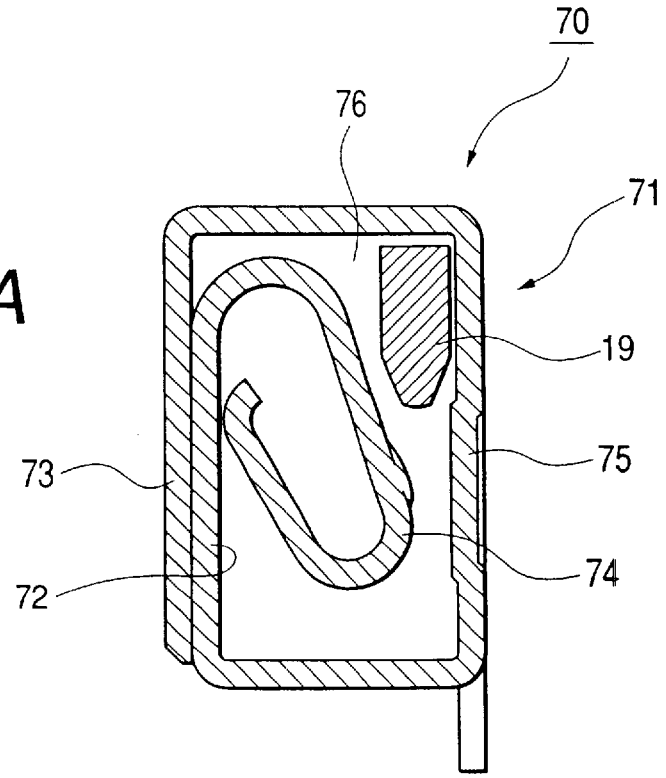
Figure 21B:
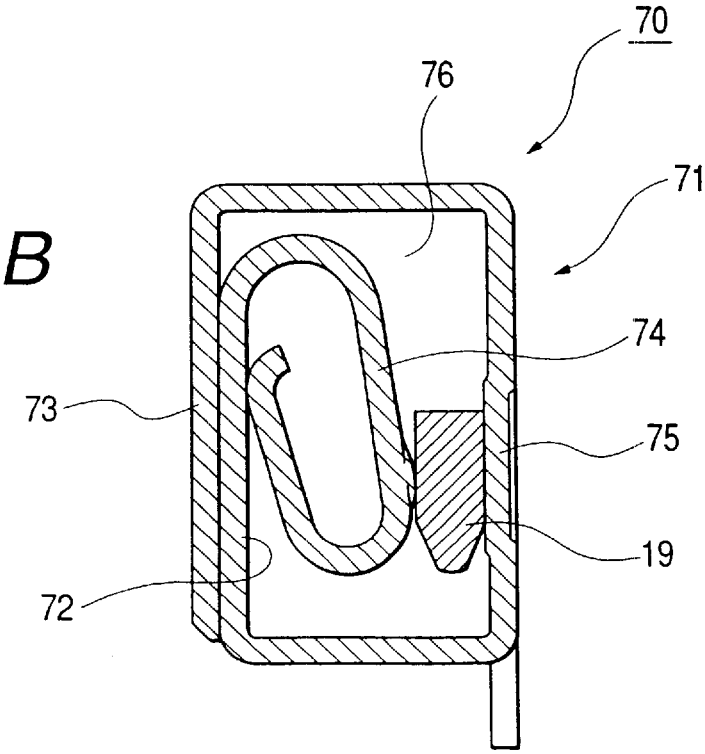

Next, referring to FIG. 21, Embodiment 3 of the present invention will be explained below.

The female terminal metal fitting 70 of this Embodiment 3 is different from that of the above Embodiment 1. Other points of the structure of Embodiment 3 are the same as those of Embodiment 1. Accordingly, like reference characters are used to indicate like parts in Embodiments 1 and 3, and the explanations of the structure, action and effect are omitted here.

The female terminal metal fitting 70 of Embodiment 3 is composed as follows. One side wall of the engaging section 71 is formed into a double plate structure composed of the side walls 72, 73. When a portion of the inner side wall 72, which extends from the upper end of the inner side wall 72, is folded back downward, and this folded portion is further folded back upward, so that the elastic contact piece 74 is formed. The size of the elastic contact piece 74 extends to the entire region of the engaging section 71 in the vertical direction. A gap formed between the elastic contact piece 74 and the wall section 75, which is arranged on the opposite side to the elastic contact piece 74 and not continued to the elastic contact piece 74, is larger than the with of the tab 19 in its upper portion. This gap functions as the accommodating space 76.

EMBODIMENT 4

Figure 22A:
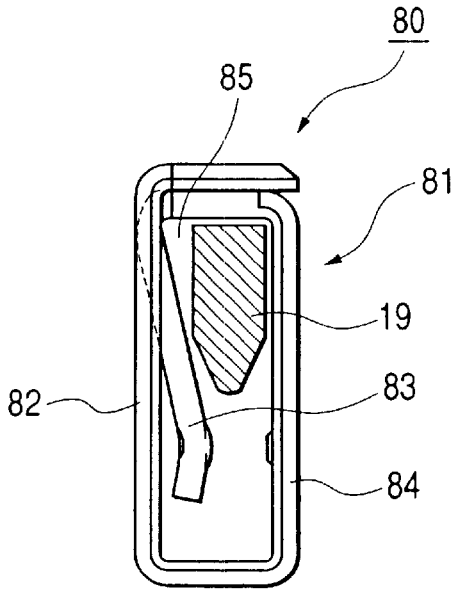
Figure 22B:
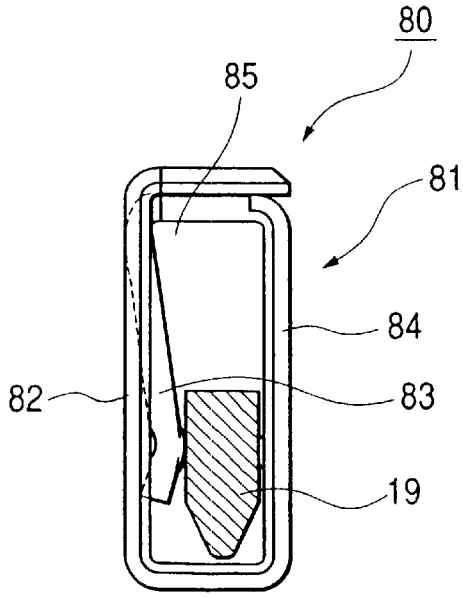

Next, referring to FIG. 22, Embodiment 4 of the present invention will be explained below.

The female terminal metal fitting 80 of this Embodiment 4 is different from that of the above Embodiment 1. Other points of the structure of Embodiment 4 are the same as those of Embodiment 1. Accordingly, like reference characters are used to indicate like parts in Embodiments 1 and 4, and the explanations of the structure, action and effect are omitted here.

The female terminal metal fitting 80 of Embodiment 4 is formed in such a manner that a portion of the one side wall 82 of the engaging section 81 is raised by cutting so as to form the elastic contact piece 83. The elastic contact piece 83 obliquely extends inside from the upper end of the side wall 82 to the lower portion. A gap formed between the upper end portion of the elastic contact piece 83 and the side wall 84 arranged on the opposite side is made to be larger than the width of the tab 19. Due to the foregoing, the accommodation space 85 can be ensured.

ANOTHER EMBODIMENT

The present invention is not limited to the specific embodiment explained above referring to the drawings. For example, the following embodiments are included in the technical scope of the present invention. Further, variations may be made without departing from the spirit and scope of the invention.

(1) In the above embodiments, the stationary side housing is a male side housing, and the movable side housing is a female side housing. However, it should be noted that the stationary side housing may be a female side housing, and the movable side housing may be a male side housing.

(2) In the above embodiments, as a guide means, the cam groove is formed in the holder, and the cam pin is formed in the female side housing (movable side housing). However, according to the present invention, the cam pin may be formed in the holder, and the cam groove may be formed in the female side housing.

(3) In the above embodiments, as a holding means, the elastic deflection piece is provided on the holder side. However, according to the present invention, the elastic deflection piece may be provided in the female side housing.

(4) In the above embodiments, the semi-lock protrusion is formed in the movable side housing. However, according to the present invention, the semi-lock protrusion may be formed in the stationary side housing, and also the semi-lock protrusion may be formed in both the stationary side and the movable side housing.

(5) In the above embodiments, the cam groove and the cam pin, which are a guide means, are also used as an engaging means. However, according to the present invention, the engaging means may be provided independently from the guide means.

What is claimed is:

1. A connector comprising:

a stationary side housing having a stationary side terminal metal fitting;

a movable side housing having a movable side metal fitting capable of connecting with said stationary side terminal metal fitting;

a holder capable of being assembled to said stationary side housing in an assembly direction; and a guide mechanism that displaces said movable side housing with respect to said holder in a direction oblique to the assembly direction between an initial position and a connecting position, wherein when the movable side housing moves from the initial position to the connection position, said movable side terminal metal fitting moves in a direction perpendicular to the assembly direction and connects with said stationary side terminal metal fitting, said guide mechanism comprises a plurality of cam grooves formed in said holder and a plurality of cam pins formed in said movable side housing and engaged with the cam grooves, said cam grooves are provided in parallel to each other, and the plurality of cam grooves are oblique with respect to the assembly direction and shifted with respect to each other in the assembly direction.

2. The connector according to claim 1 further comprising:

a holding mechanism, which is arranged in said holder and said movable side housing, that holds said movable side housing at the initial position, said holding mechanism being capable of being released from a holding condition when said holder comes into contact with said stationary side housing in the process of assembling said holder to said stationary side housing.

3. The connector according to claim 2, further comprising:

an initial position return mechanism that restricts said movable side housing from separating from said stationary side housing when said movable side housing is at the connecting position, and allows said movable side housing to separate from said stationary side housing when said movable side housing reaches the initial position.

4. The connector according to claim 2, wherein said guide mechanism comprises a cam groove formed in the holder and a cam pin formed in said movable side housing and engaged with the cam groove, said holder includes an idly engaging groove extending parallel to the assembly direction and continuous with an end portion of the cam groove at which the cam pin is located when said movable side housing reaches the connecting position, and said cam pin is engaged with the idly engaging groove when said holder is assembled to said stationary side housing.

5. The connector according to claim 2, wherein said guide mechanism comprises a plurality of cam grooves formed in said holder and a plurality of cam pins formed in said movable side housing and engaged with the cam grooves, and the cam grooves are provided in parallel to each other.

6. The connector according to claim 2, further comprising:

an initial position return mechanism that restricts said movable side housing from separating from said stationary side housing when said movable side housing is at the connecting position, and allows said movable side housing to separate from said stationary side housing when said movable side housing reaches the initial position.

7. The connector according to claim 2, wherein said holding mechanism comprises:

an elastic deflection piece arranged in one of said holder and said movable side housing, said elastic deflection piece holding said movable side housing at the initial position when said elastic deflection piece is engaged with the other of said holder and said movable side housing; and a releasing section, which is arranged in said stationary side housing, for elastically displacing said elastic deflection piece in a releasing direction when said releasing section comes into contact with said elastic deflection piece when said movable side housing comes into contact with said stationary side housing and further movement of said movable side housing in the assembly direction is restricted.

8. The connector according to claim 7, wherein said guide mechanism comprises a cam groove formed in the holder and a cam pin formed in said movable side housing and engaged with the cam groove, said holder includes an idly engaging groove extending parallel to the assembly direction and continuous with an end portion of the cam groove at which the cam pin is located when said movable side housing reaches the connecting position, and said cam pin is engaged with the idly engaging groove when said holder is assembled to said stationary side housing.

9. The connector according to claim 7, wherein said guide mechanism comprises a plurality of cam grooves formed in said holder and a plurality of cam pins formed in said movable side housing and engaged with the cam grooves, and the cam grooves are provided in parallel to each other.

10. The connector according to claim 7, further comprising:

an initial position return mechanism that restricts said movable side housing from separating from said stationary side housing when said movable side housing is at the connecting position, and allows said movable side housing to separate from said stationary side housing when said movable side housing reaches the initial position.

11. The connector according to claim 3, further comprising:

an initial position return mechanism that restricts said movable side housing from separating from said stationary side housing when said movable side housing is at the connecting position, and allows said movable side housing to separate from said stationary side housing when said movable side housing reaches the initial position.

12. A connector comprising:

a stationary side housing having a stationary side terminal metal fitting;

a movable side housing having a movable side metal fitting capable of connecting with said stationary side terminal metal fitting;

a holder capable of being assembled to said stationary side housing in an assembly direction; and a guide mechanism that displaces said movable side housing with respect to said holder in a direction oblique to the assembly direction between an initial position and a connecting position; wherein said guide mechanism comprises a cam groove formed in the holder and a cam pin formed in said movable side housing and engaged with the cam groove, said holder includes an idly engaging groove extending parallel to the assembly direction and continuous with an end portion of the cam groove at which the cam pin is located when said movable side housing reaches the connecting position, said cam pin is engaged with the idly engaging groove when said holder is assembled to said stationary side housing, and when the movable side housing moves from the initial position to the connection position, said movable side terminal metal fitting moves in a direction perpendicular to the assembly direction and connects with said stationary side terminal metal fitting.

13. The connector according to claim 12, wherein said guide mechanism comprises a plurality of cam grooves formed in said holder and a plurality of cam pins formed in said movable side housing and engaged with the cam grooves, and the cam grooves are provided in parallel to each other.

14. The connector according to claim 12, further comprising:

an initial position return mechanism that restricts said movable side housing from separating from said stationary side housing when said movable side housing is at the connecting position, and allows said movable side housing to separate from said stationary side housing when said movable side housing reaches the initial position.

15. The connector according to claim 12, further comprising:

an initial position return mechanism that restricts said movable side housing from separating from said stationary side housing when said movable side housing is at the connecting position, and allows said movable side housing to separate from said stationary side housing when said movable side housing reaches the initial position.

16. A connector comprising:

a stationary side housing having a stationary side terminal metal fitting;

a movable side housing having a movable side metal fitting capable of connecting with said stationary side terminal metal fitting;

a holder capable of being assembled to said stationary side housing in an assembly direction;

a guide mechanism that displaces said movable side housing with respect to said holder in a direction oblique to the assembly direction between an initial position and a connecting position; and an initial position return mechanism that restricts said movable side housing from separating from said stationary side housing when said movable side housing is at the connecting position, and allows said movable side housing to separate from said stationary side housing when said movable side housing reaches the initial position, wherein when the movable side housing moves from the initial position to the connection position, said movable side terminal metal fitting moves in a direction perpendicular to the assembly direction and connects with said stationary side terminal metal fitting.

17. The connector according to claim 16, wherein said initial position return mechanism includes a semi-lock mechanism that applies a restricting action that restricts said movable side housing, which has returned to the initial position, from moving in a separating direction with respect to said stationary side housing, the restricting action being released when a predetermined separating force is applied to the semi-lock mechanism, and said holder and said movable side housing include an engaging mechanism that engages said movable side housing and said holder so that said movable side housing and said holder can be integrally displaced in the separating direction when said movable side housing returns to the initial position.

18. A connector comprising:

a stationary side housing having a stationary side terminal metal fitting;

a movable side housing having a movable side metal fitting capable of connecting with said stationary side terminal metal fitting a holder capable of being assembled to said stationary side housing in an assembly direction; and a guide mechanism that displaces said movable side housing with respect to said holder in a direction oblique to the assembly direction between an initial position and a connecting position; wherein when the movable side housing moves from the initial position to the connection position, said movable side terminal metal fitting moves in a direction perpendicular to the assembly direction and connects with said stationary side terminal metal fitting;

the stationary side terminal metal fitting comprises a tubular member including a sidewall, and an elastic contact piece protruding inward from the sidewall, wherein the movable side terminal metal fitting engages with the elastic contact piece when the movable side housing moves to the connecting position, and disengages from the elastic contact piece when the movable side housing moves to the initial position.

* * * * *